US008666292B2

(12) United States Patent
Shimizu et al.

(10) Patent No.: US 8,666,292 B2
(45) Date of Patent: Mar. 4, 2014

(54) DEVELOPER CASE AND IMAGE FORMING APPARATUS TO WHICH DEVELOPER CASE IS APPLIED

(75) Inventors: Tamotsu Shimizu, Osaka (JP); Takahisa Nakaue, Osaka (JP); Teruhiko Nagashima, Osaka (JP); Takashi Morita, Osaka (JP); Eiji Nimura, Osaka (JP); Yoshihiro Yamagishi, Osaka (JP); Koji Kuramashi, Osaka (JP); Masaki Hayashi, Osaka (JP); Ikuo Makie, Osaka (JP); Kenichi Tamaki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 52 days.

(21) Appl. No.: 13/447,588

(22) Filed: Apr. 16, 2012

(65) Prior Publication Data

US 2013/0101317 A1 Apr. 25, 2013

(30) Foreign Application Priority Data

Apr. 15, 2011 (JP) ..... 2011-091259
Apr. 15, 2011 (JP) ..... 2011-091260
Oct. 24, 2011 (JP) ..... 2011-232939

(51) Int. Cl.
*G03G 15/08* (2006.01)

(52) U.S. Cl.
USPC ..... 399/258; 399/260; 399/263

(58) Field of Classification Search
USPC ..... 399/258, 260, 262, 263
See application file for complete search history.

(56) References Cited

U.S. PATENT DOCUMENTS

| | | | | |
|---|---|---|---|---|
| 3,724,725 | A | 4/1973 | Stauffer | |
| 5,307,129 | A | 4/1994 | Miura et al. | |
| 8,331,830 | B2 * | 12/2012 | Yoshihara | 399/258 |
| 8,422,920 | B2 * | 4/2013 | Tanaka | 399/258 |
| 2001/0046395 | A1 | 11/2001 | Ashikari et al. | |
| 2008/0056772 | A1 | 3/2008 | Utsumi et al. | |
| 2008/0260431 | A1 | 10/2008 | Saito | |
| 2009/0092419 | A1 | 4/2009 | Iwata et al. | |
| 2011/0229213 | A1 | 9/2011 | Mihara et al. | |

FOREIGN PATENT DOCUMENTS

| | | |
|---|---|---|
| JP | 2-100267 | 8/1990 |
| JP | 05046021 | 2/1993 |
| JP | 05053438 | 3/1993 |
| JP | 5-43163 | 6/1993 |
| JP | 2003287948 | 10/2003 |
| JP | 2004-198544 | 7/2004 |
| JP | 2011-033706 | 2/2011 |

OTHER PUBLICATIONS

European Search Report—EP 12164241—dated Oct. 19, 2012 (6 pages).
Korean Office Action dated Oct. 17, 2013, 5 pages.

* cited by examiner

*Primary Examiner* — Hoang Ngo
(74) *Attorney, Agent, or Firm* — K&L Gates LLP

(57) ABSTRACT

A developer case has a main body, a cylindrical portion, and a rotating unit. The main body has a bottom wall. The cylindrical portion has a discharge port. The rotating unit is located so as to extend across the main body and the cylindrical portion, transports developer in the main body, and has a rotating shaft, a first transport member, a second transport member, and dispersing members. The rotating shaft has a first portion located in the main body and a second portion located in the cylindrical portion. The first transport member transports developer in a first transport direction from the cylindrical portion to the main body. The second transport member transports developer in a second transport direction from the main body to the cylindrical portion. The dispersing members move developer in the radial direction.

23 Claims, 29 Drawing Sheets

DEVELOPER CASE AND IMAGE FORMING APPARATUS TO WHICH DEVELOPER CASE IS APPLIED

INCORPORATION BY REFERENCE

This application is based upon and claims the benefit of priority from the corresponding Japanese Patent application Nos. 2011-091259 and 2011-091260, both filed on Apr. 15, 2011, and Japanese Patent application No. 2011-232939, filed on Oct. 24, 2011, the entire contents of which are incorporated herein by reference.

BACKGROUND

The present disclosure relates to a developer case for storing developer, and an image forming apparatus to which the developer case is attached.

In an image forming apparatus, that forms an image on a sheet using toner (developer), a developer case such as a toner container is necessary. A toner container stores toner to be supplied to a developing unit, and is detachably attached to an image forming apparatus. In general, a toner container has a main body that serves as a storage space for toner, a discharge port located in the bottom wall of the main body, a transport screw that transports toner toward the discharge port, and an agitating paddle that moves toner in the main body. The spiral of the transport screw has a double spiral structure consisting of a radially inner spiral and a radially outer spiral.

One of the important considerations in a toner container is to discharge toner through the discharge port such that no toner remains in the main body. However, the shape of a toner container is determined based not only on the ease of toner discharge, but also the design of the image forming apparatus. For this reason, depending on the shape of a container, toner can become packed in the vicinity of the discharge port, and the discharge of toner hindered.

SUMMARY

A developer case according to an embodiment of the present disclosure is provided that includes a main body, a cylindrical portion, and a rotating unit. The main body has a bottom wall and contains developer. The cylindrical portion connects to the bottom wall, protrudes from the main body, and has a discharge port. The rotating unit is positioned so as to extend across the main body and the cylindrical portion, transports the developer in the main body, has a rotating shaft, a first transport member, a second transport member, and dispersing members. The rotating shaft extends in the direction in which the bottom wall extends and has a first portion located in the main body and a second portion located in the cylindrical portion. The first transport member is located on the circumferential surface of the second portion of the rotating shaft, rotates integrally with the rotating shaft, and transports the developer in a first transport direction from the cylindrical portion to the main body. The second transport member is positioned over the circumferential surface of the first portion of the rotating shaft and on the radially outer side of the first transport member, rotates integrally with the rotating shaft, and transports the developer in a second transport direction from the main body to the cylindrical portion. The dispersing members extend parallel to the rotating shaft and across the first portion and the second portion and disperse the developer in the radial direction.

An image forming apparatus according to an embodiment of the present disclosure is provided that includes an image bearing member that bears a developer image on the circumferential surface thereof, a developing unit that supplies developer to the image bearing member, and the above-described developer case according to an embodiment of the present disclosure, the developer case being detachably connected to the developing unit and supplying the developer to the developing unit.

A developer case according to another embodiment of the present disclosure is provided that includes a main body, a cylindrical portion, and a rotating unit. The main body has a bottom wall and contains developer. The cylindrical portion connects to the bottom wall, protrudes from the main body, and has a discharge port. The rotating unit is positioned so as to extend across the main body and the cylindrical portion, transports the developer in the main body, has a rotating shaft, a first transport member, and a second transport member. The rotating shaft extends in a direction in which the bottom wall extends. The first transport member is located on the circumferential surface of the rotating shaft, rotates integrally with the rotating shaft, and transports the developer in a first transport direction from the cylindrical portion to the main body. The second transport member is located over the circumferential surface of the rotating shaft and on the radially outer side of the first transport member, rotates integrally with the rotating shaft, and transports the developer in a second transport direction from the main body to the cylindrical portion. The cylindrical portion has an inner wall surface that is circular in cross-section and corresponds to the rotation locus of the most radially extending part of the second transport member.

An image forming apparatus according to another embodiment of the present disclosure is provided that includes an image bearing member that bears a developer image on the circumferential surface thereof, a developing unit that supplies developer to the image bearing member, and the above-described developer case according to another embodiment of the present disclosure, the developer case being detachably connected to the developing unit and supplying the developer to the developing unit.

Additional features and advantages are described herein, and will be apparent from the following Detailed Description and the figures.

DETAILED DESCRIPTION

Figure 1:
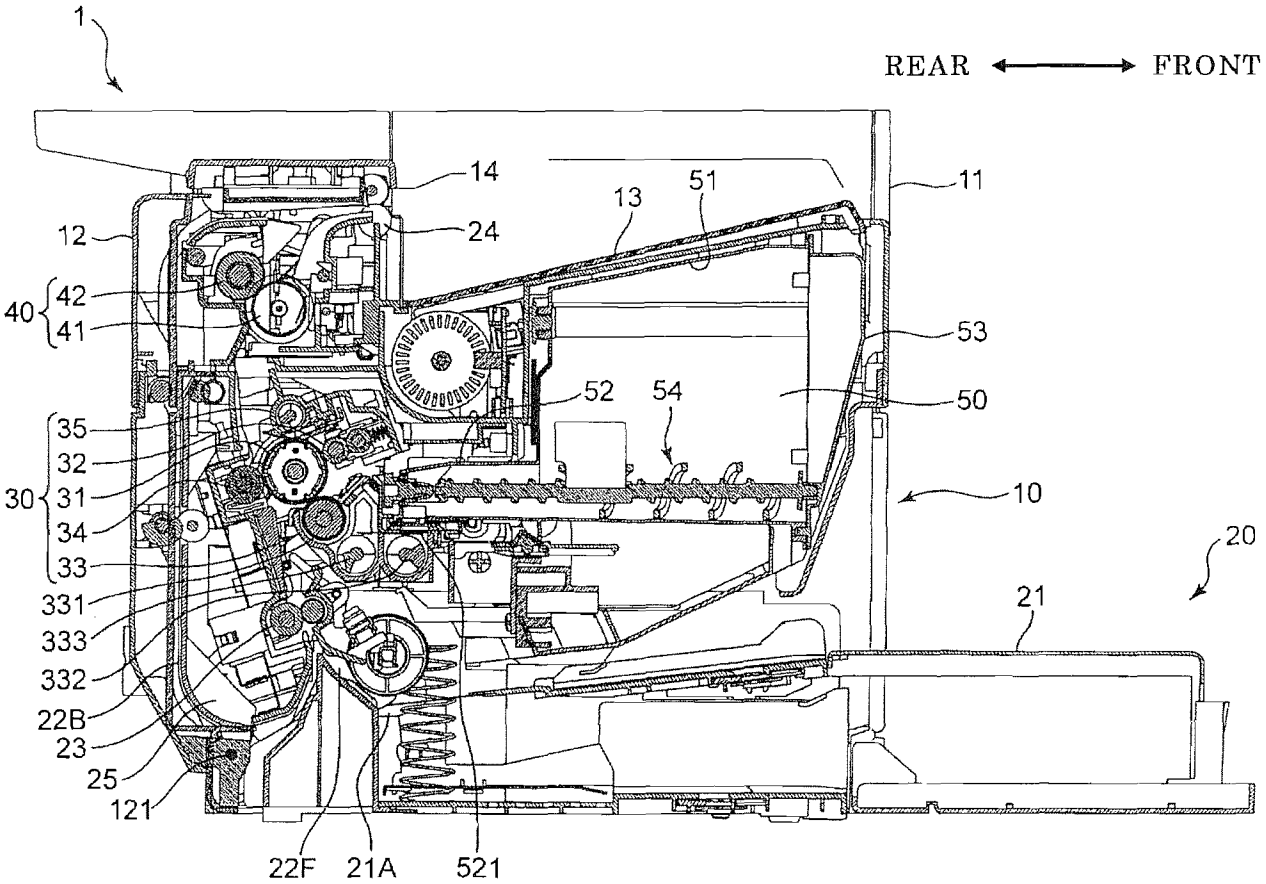
FIG. 1 is a sectional view showing the internal structure of an image forming apparatus according to an embodiment of the present disclosure.

Embodiments of the present disclosure will now be described in detail with reference to the drawings. FIG. 1 is a sectional view showing the internal structure of an image forming apparatus 1 according to an embodiment of the present disclosure. Although a monochrome printer will be used as an example of an image forming apparatus 1, other examples of image forming apparatus include a copying machine, a facsimile machine, a multifunction device having the functions of these, and an image forming apparatus that forms a color image.

The image forming apparatus 1 includes a main body housing 10 having a substantially rectangular parallelepiped housing structure, and a paper feed portion 20, an image forming portion 30, a fixing portion 40, and a toner container 50 (developer case) contained in the main body housing 10.

A front cover 11 is located on the front side (the right side of FIG. 1) of the main body housing 10. A rear cover 12 is located on the rear side of the main body housing 10. By opening the front cover 11, the user can take out the toner container 50 from the front side of the main body housing 10 when the image forming apparatus 1 is out of toner (developer). The rear cover 12 is a cover that is opened to remove paper jams or perform maintenance. By opening the rear cover 12, the user can take out the image forming portion 30 and the fixing portion 40 from the rear of the main body housing 10. On the upper surface of the main body housing 10, a paper ejection portion 13, onto which sheets after image formation are ejected, is located.

The paper feed portion 20 includes a paper cassette 21 that contains sheets that undergo an image forming process. Part of the paper cassette 21 extends from the front of the main body housing 10. The paper cassette 21 includes a sheet containing space in which a stack of the sheets is contained, and a lift plate that lifts up the stack of sheets for paper feeding. A sheet sending-out portion 21A is located above the rear end of the paper cassette 21. In the sheet sending-out portion 21A, a pickup roller (not shown) for sending out the sheets in the uppermost layer of the stack of sheets in the paper cassette 21 one at a time, is located.

The image forming portion 30 performs an image forming process, and more specifically, forms a toner image on a sheet sent out from the paper feed portion 20. The image forming portion 30 includes a photosensitive drum 31 (image bearing member), and a charging unit 32, an exposing unit (not shown in FIG. 1), a developing unit 33, a transfer roller 34, and a cleaning unit 35 that are positioned around the photosensitive drum 31.

The photosensitive drum 31 rotates about its axis, and an electrostatic latent image and a toner image (developer image) is formed on the circumferential surface thereof. For example, a photosensitive drum formed of an amorphous silicon (a-Si) material is used as the photosensitive drum 31. The charging unit 32 uniformly charges the surface of the photosensitive drum 31 and includes a charging roller in contact with the photosensitive drum 31. The exposing unit has a laser light source and optical system devices, such as mirrors and lenses, and irradiates the circumferential surface of the photosensitive drum 31 with light modulated based on the image data provided by an external device such as a personal computer, thereby forming an electrostatic latent image.

The developing unit 33 supplies toner to the circumferential surface of the photosensitive drum 31 in order to develop the electrostatic latent image on the photosensitive drum 31 and form a toner image. The developing unit 33 includes a developing roller 331 that includes toner to be supplied to the photosensitive drum 31 and a first transport screw 332 and second transport screw 333 that circulate and transport developer while agitating it in a housing 60 (see FIG. 2 to FIG. 5). The developing unit 33 will be described hereinafter.

The transfer roller 34 transfers a toner image formed on the circumferential surface of the photosensitive drum 31 to a sheet. The transfer roller 34 and the photosensitive drum 31 form a transfer nip portion therebetween. A transfer bias of opposite polarity to toner is applied to the transfer roller 34. The cleaning unit 35 has a cleaning roller or the like, and cleans the circumferential surface of the photosensitive drum 31 after the transfer of the toner image.

The fixing portion 40 fixes the transferred toner image to the sheet. The fixing portion 40 includes a fixing roller 41 that has a heat source therein, and a pressure roller 42 that is pressed against the fixing roller 41. The fixing roller 41 and the pressure roller 42 form a fixing nip portion therebetween. When the sheet to which the toner image is transferred passes through the fixing nip portion, the toner image is fixed to the sheet by being heated by the fixing roller 41 and being pressed by the pressure roller 42.

Toner to be supplied to the developing unit 33 is stored in the toner container 50. The toner container 50 includes a main body 51, in which toner is stored, a cylindrical portion 52 extending from the lower part of one side surface (the rear surface in FIG. 1) of the main body 51, a lid member 53 that covers another side surface of the main body 51, and a rotating unit 54 that is contained in the container and transports toner. By rotationally driving the rotating unit 54, toner stored in the toner container 50 is supplied to the inside of the developing unit 33 through a discharge port 521 located in the lower surface of the distal end of the cylindrical portion 52. The toner container 50 will be described hereinafter with reference to FIG. 6 to FIG. 29.

In the main body housing 10, a main transport path 22F and a reverse transport path 22B are provided in order to transport sheets. The main transport path 22F extends from the sheet sending-out portion 21A of the paper feed portion 20 through the image forming portion 30 and the fixing portion 40 to a paper ejection opening 14 located opposite to the paper ejection portion 13 on the upper surface of the main body housing 10. The reverse transport path 22B is a transport path for returning a sheet that has undergone one-side printing to the upstream side of the image forming portion 30 in the main transport path 22F, and is used when duplex printing is performed on a sheet.

A registration roller pair 23 is located upstream of the transfer nip portion between the photosensitive drum 31 and the transfer roller 34 in the main transport path 22F. The sheet is temporarily stopped by the registration roller pair 23, undergoes skew correction, and is then sent out to the transfer nip portion at a predetermined timing for image transfer. At appropriate positions in the main transport path 22F and the reverse transport path 22B, a plurality of transport rollers for transporting sheets are disposed. For example, in the vicinity of the paper ejection opening 14, a paper ejection roller pair 24 is disposed.

The reverse transport path 22B is formed between the outer surface of a reversing unit 25 and the inner surface of the rear cover 12 of the main body housing 10. On the inner surface of the reversing unit 25, the transfer roller 34 and one of the registration roller pair 23 are mounted. The rear cover 12 and the reversing unit 25 are each rotatable about the axis of a fulcrum portion 121 provided at the lower ends thereof. If a sheet jams in the reverse transport path 22B, the rear cover 12 is opened. If a sheet jams in the main transport path 22F, or when the unit of the photosensitive drum 31 and/or the developing unit 33 is taken out, the rear cover 12 and the reversing unit 25 are opened.

Figure 2:
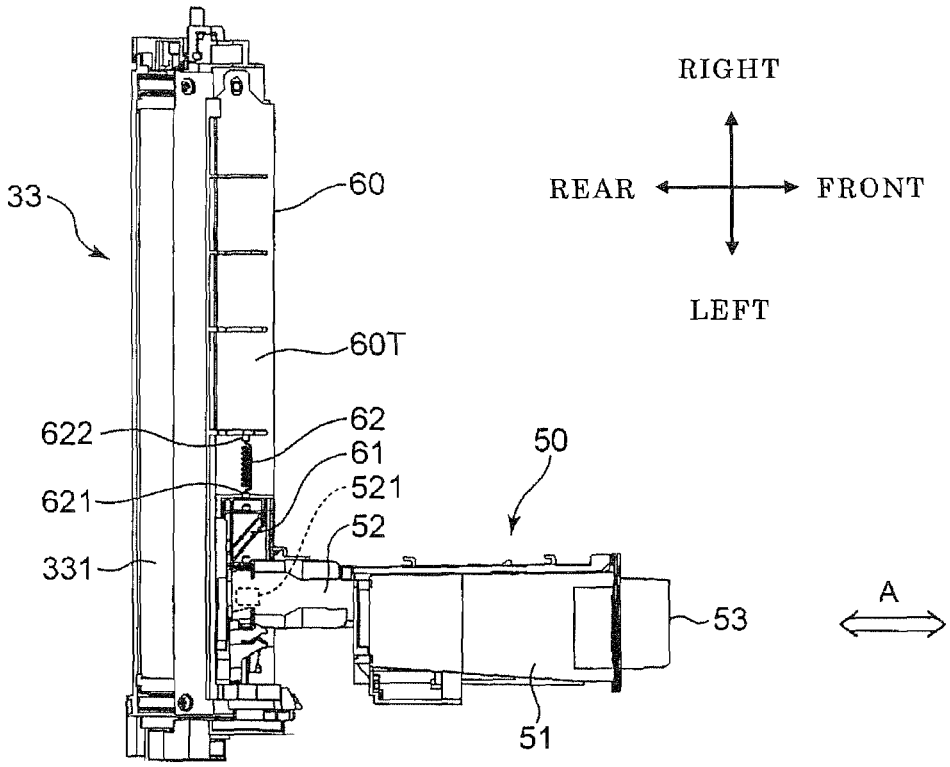
FIG. 2 is a plan view showing a developing unit and a toner container incorporated in the image forming apparatus.
Figure 3:
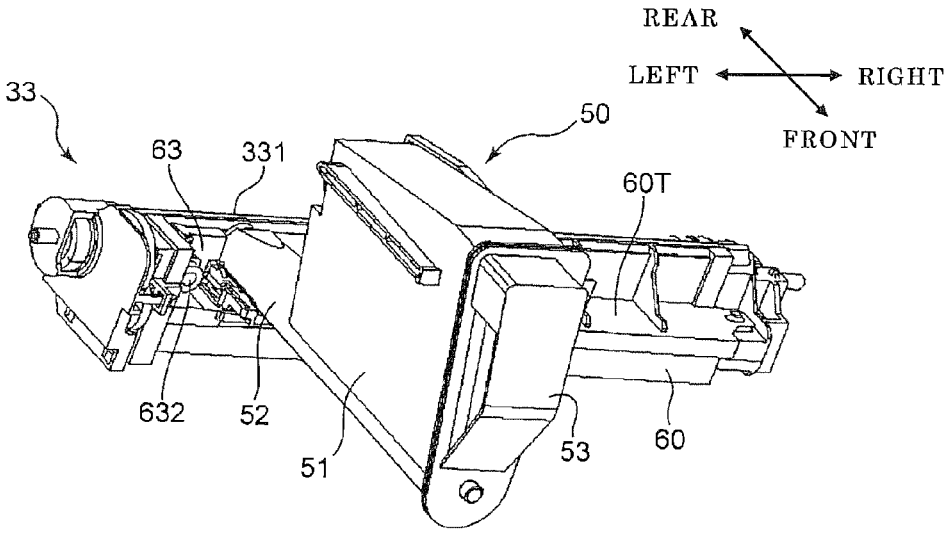
FIG. 3 is a perspective view of the developing unit and the toner container shown in FIG. 2.
Figure 4:
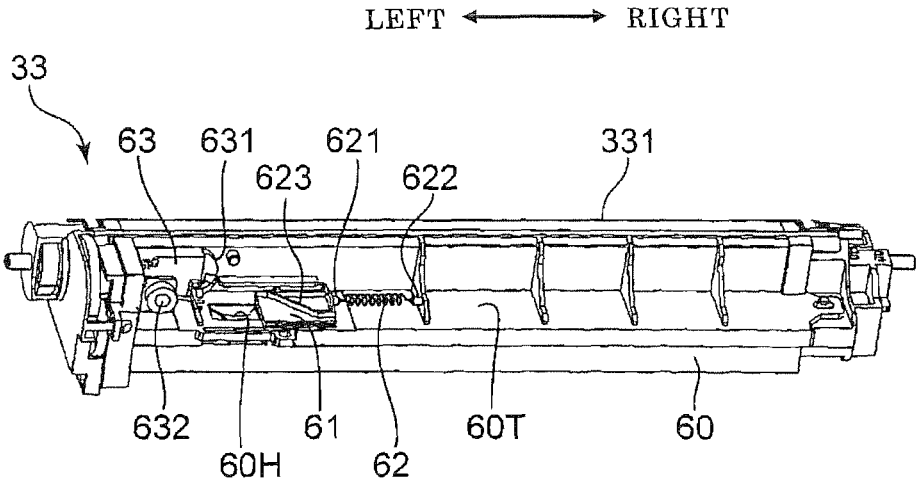
FIG. 4 is a perspective view of the developing unit alone.
Figure 5:
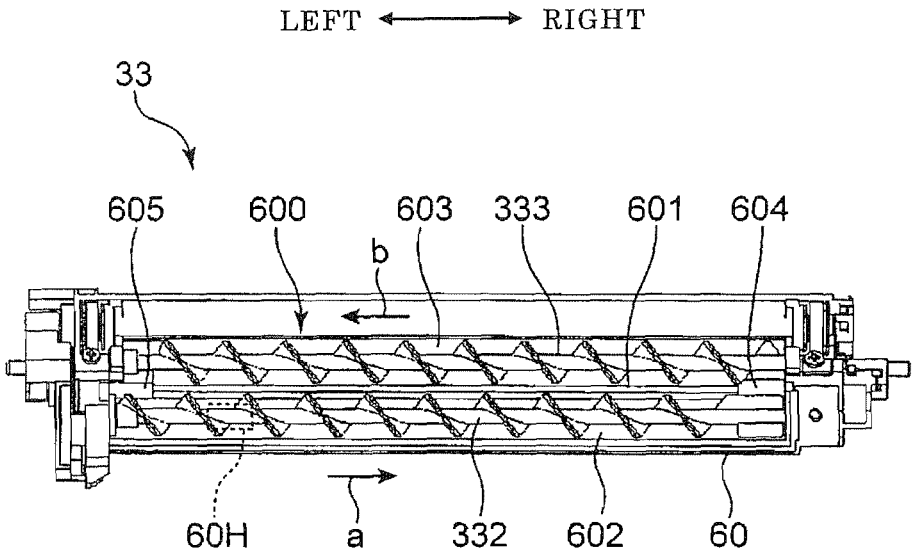
FIG. 5 is a plan view showing the internal structure of the developing unit.
Figure 6:
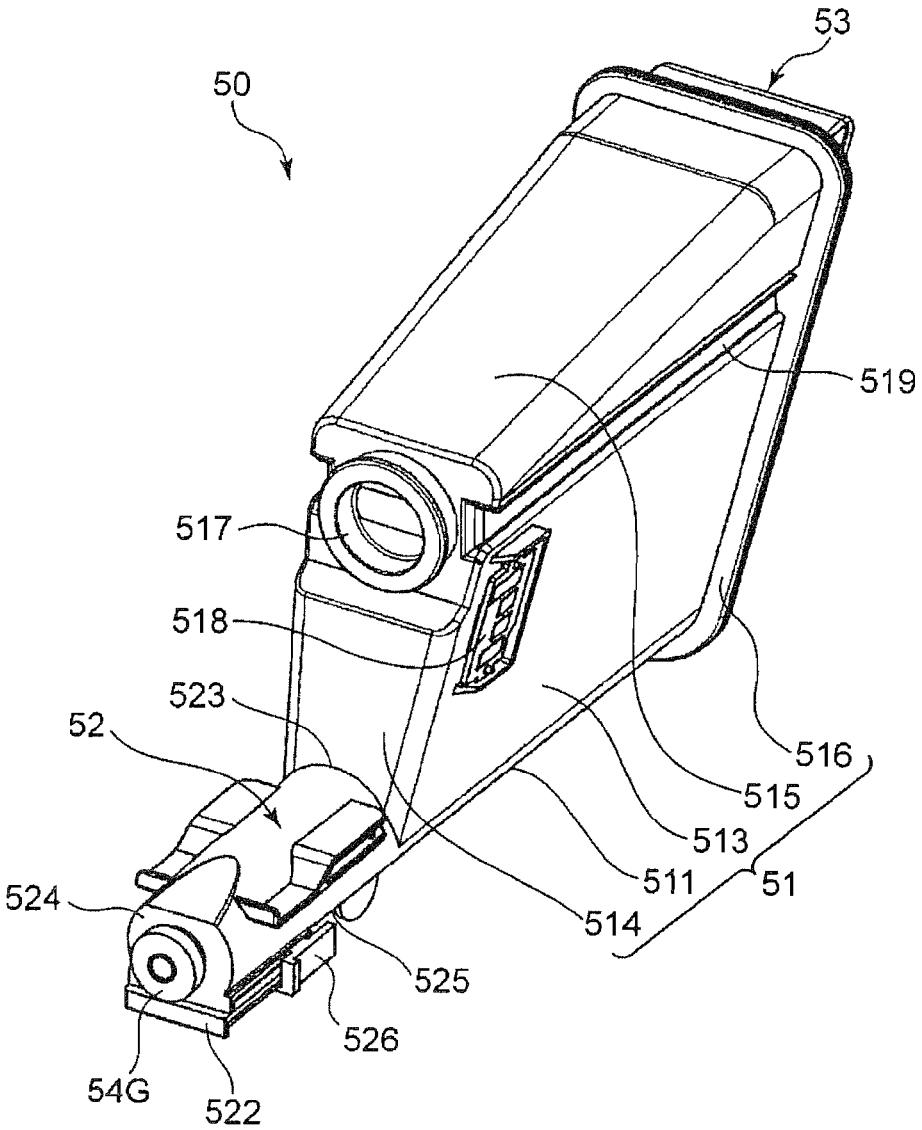
FIG. 6 is a perspective view of a toner container in an embodiment.
Figure 7:
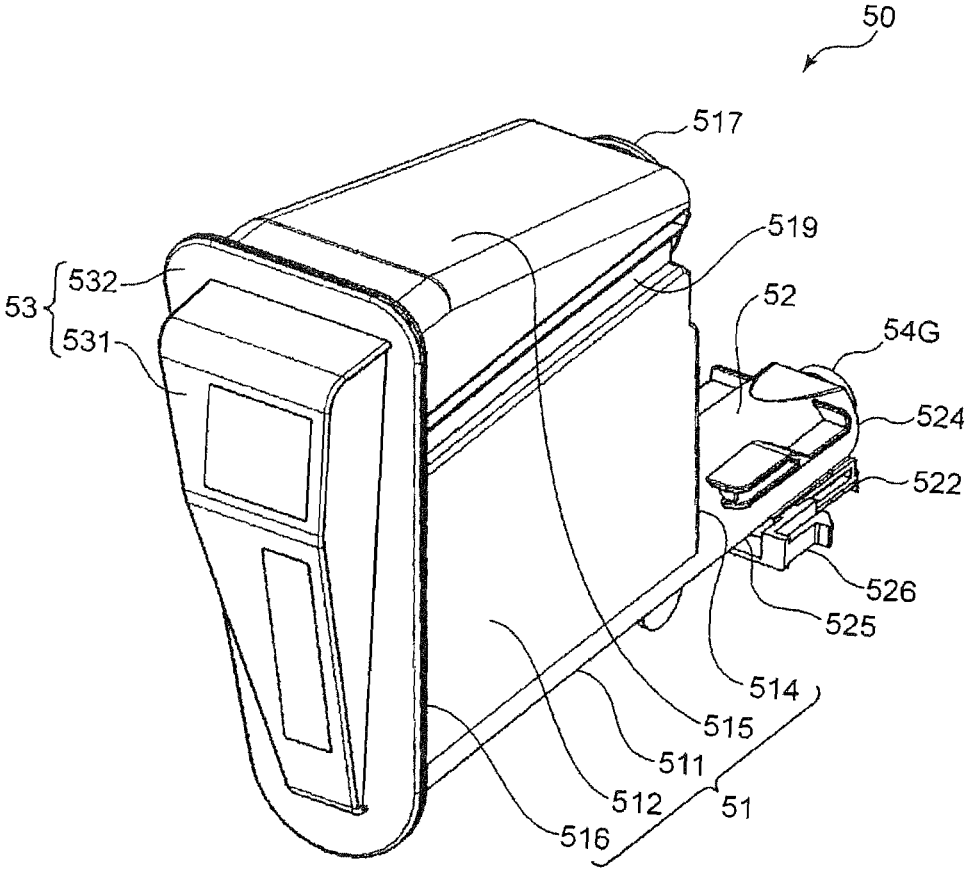
FIG. 7 is a perspective view of the toner container from the direction opposite that of FIG. 6.

Next, with reference to FIG. 2 to FIG. 7, the structure of the developing unit 33 and the toner container 50 and the positional relationship therebetween will be described. FIG. 2 is a plan view showing the developing unit 33 and the toner container 50 in a mounted state. FIG. 3 is a perspective view of same. FIG. 4 is a perspective view of the developing unit 33 alone. FIG. 5 is a plan view showing the internal structure of the developing unit 33. FIG. 6 and FIG. 7 are perspective views of the toner container alone.

The developing unit 33 comprises a housing 60 having a box shape that is elongate in one direction (the axial direction of the developing roller 331). The housing 60 has an opening extending in its longitudinal direction. Part of the circumferential surface of the developing roller 331 is exposed in this opening. In this embodiment, the housing 60 is mounted in the main body housing 10 such that its longitudinal direction corresponds to the left-right direction (first direction) of the main body housing 10.

In the top plate 60T near the left end of the housing 60, a toner replenishment opening 60H for introducing toner supplied from the toner container 50 into the housing is located. The developing unit 33 and the toner container 50 are mounted such that the toner replenishment opening 60H is located directly below the discharge port 521 of the toner container 50. As shown by arrow A in FIG. 2, the toner container 50 is connected to and detached from the developing unit 33 in a direction perpendicular to the longitudinal direction of the housing 60 (front-rear direction/second direction). The toner container 50 has a housing shape that is elongate in one direction in top view. Thus, when the toner container 50 is connected to the developing unit 33, they form a substantially L-shaped structure in top view (see FIG. 2).

On the upper surface of the top plate 60T, a developing shutter plate 61 that can slide in the left-right direction is located. The developing shutter plate 61 is always urged leftward by an urging spring 62. The urging spring 62 is a coil spring. One end of the urging spring 62 is attached to a spring seat 621 located on the right end edge of the developing shutter plate 61, and the other end thereof is attached to a spring seat 622 located on a rib adjacent to the developing shutter plate 61. Although in FIG. 4 the toner replenishment opening 60H is open, when the toner container 50 is not connected, the developing shutter plate 61 is located on the left by being urged by the urging spring 62 and covers the toner replenishment opening 60H.

A pressing plate 522 is attached to the lower part of the distal end (second end portion 524) of the cylindrical portion 52 of the toner container 50. A container gear 54G for inputting a rotational drive force into the rotating unit 54 is exposed on the distal end surface of the cylindrical portion 52. In the back left part of the toner replenishment opening 60H of the housing 60, a gear holder 63 having an input gear 631 and a coupling 632 is located. A rotational drive force from a motor (not shown) provided in the main body housing 10 is applied to the coupling 632. When the toner container 50 is connected to the developing unit 33, the input gear 631 meshes with the container gear 54G and transmits the rotational drive force to the container gear 54G.

When the toner container 50 is connected to the developing unit 33, the cylindrical portion 52 of the toner container 50 approaches the toner replenishment opening 60H from the front. At this time, the pressing plate 522 of the toner container 50 interferes with the developing shutter plate 61 covering the toner replenishment opening 60H and moves the developing shutter plate 61 to the right. Specifically, an oblique ridge 623 located on the upper substrate of the developing shutter plate 61 interferes with the pressing plate 522, and the developing shutter plate 61 is pushed to the right against the urging force of the urging spring 62. When the cylindrical portion 52 of the toner container 50 reaches a predetermined position, the toner replenishment opening 60H is completely opened, and the container gear 54G meshes with the input gear 631.

As shown in FIG. 5, the housing 60 has an internal space 600. In a two-component development system, the internal space 600 is filled with a developer consisting of toner and carrier. In the internal space 600, carrier is mixed with toner by agitation, charges toner, and transports toner to the developing roller 331. Toner is successively supplied to the developing roller 331 and consumed, and the same amount of toner as the toner consumed is appropriately supplied from the toner container 50.

The internal space 600 of the housing 60 is partitioned by a partition plate 601 extending in the left-right direction into a first path 602 and a second path 603 that are elongate in the left-right direction. The partition plate 601 is shorter than the width of the housing 60 in the left-right direction. At the right end and left end of the partition plate 601, a first communication portion 604 and a second communication portion 605 that connect the first path 602 and the second path 603 are provided. Thus, a circulation route consisting of the first path 602, the first communication portion 604, the second path 603, and the second communication portion 605 is formed in the housing 60.

The toner replenishment opening 60H is located over the vicinity of the left end of the first path 602. A first transport screw 332 is contained in the first path 602, and a second transport screw 333 is contained in the second path 603. The first and second transport screws 332 and 333 each include a shaft and a spiral blade extending from the circumference of this shaft. The first transport screw 332 is rotationally driven about its shaft and thereby transports developer in the direction of arrow a in FIG. 5. The second transport screw 333 is rotationally driven about its shaft and thereby transports developer in the direction of arrow b.

By rotationally driving the first and second transport screws 332 and 333, developer is circulated and transported along the above-described circulation route. Toner newly replenished through the toner replenishment opening 60H will be described. The toner falls into the first path 602, is mixed with existing developer, and is transported by the first transport screw 332 in the direction of arrow a. At this time, toner is mixed with carrier and charged. Next, toner enters the second path 603 from the downstream end of the first path 602 through the first communication portion 604, and is transported by the second transport screw 333 in the direction of arrow b. During this transportation, toner is charged in the same manner, and part of the toner is supplied to the circumferential surface of the developing roller 331. The remaining toner and carrier are returned through the second communication portion 605 to the upstream end of the first path 602. Although in this embodiment, a developing unit that uses a two-component development system is described, other development systems, such as a one-component development system, may be used.

Figure 8:
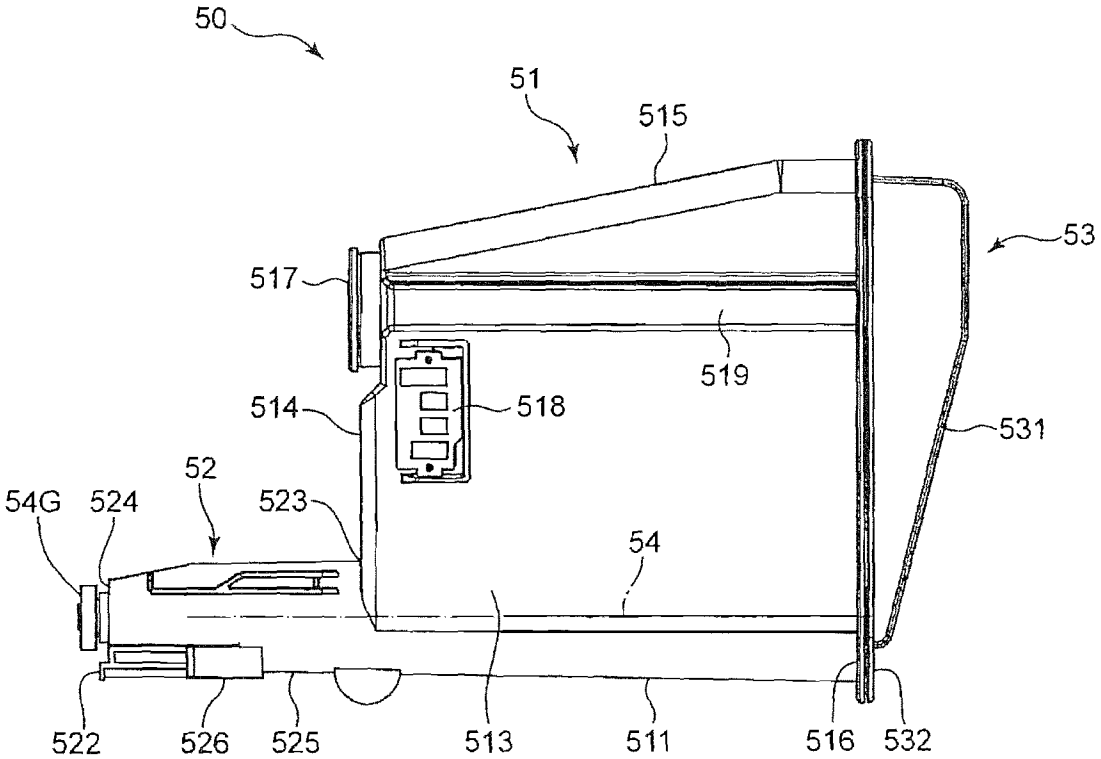
FIG. 8 is a side view of the toner container.
Figure 9:
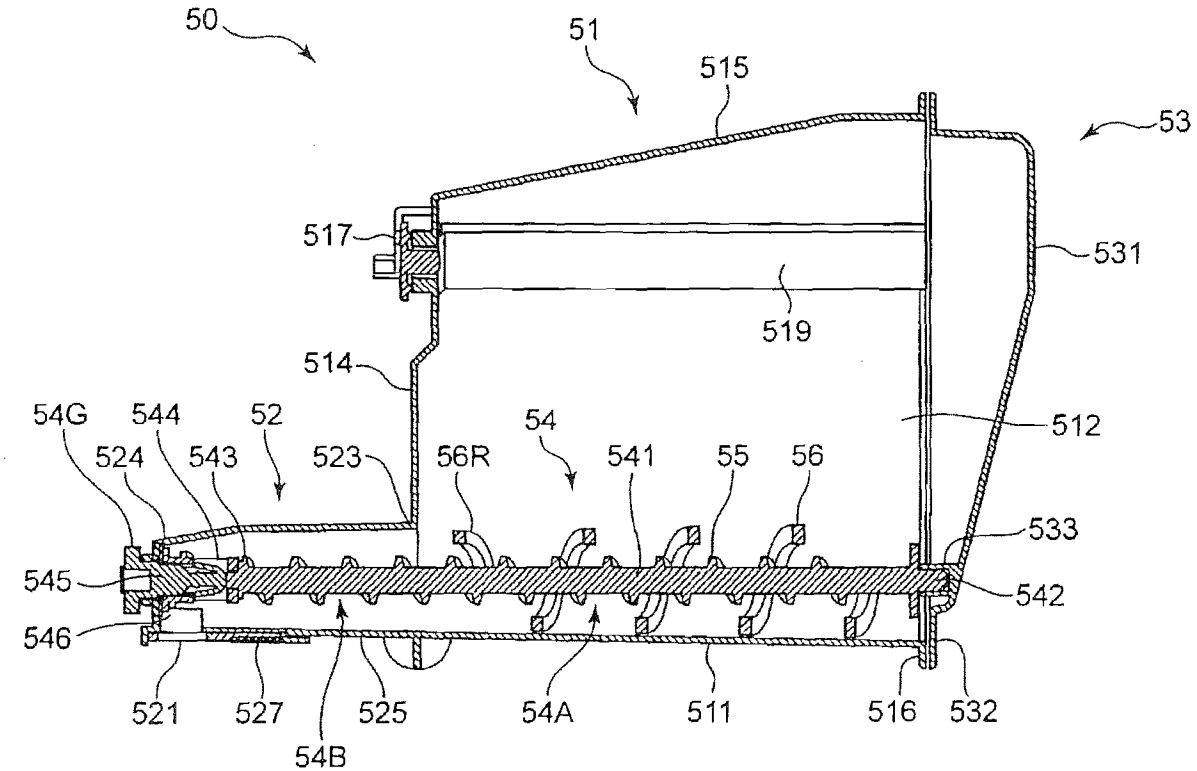
FIG. 9 is a sectional side view of the toner container.
Figure 10:
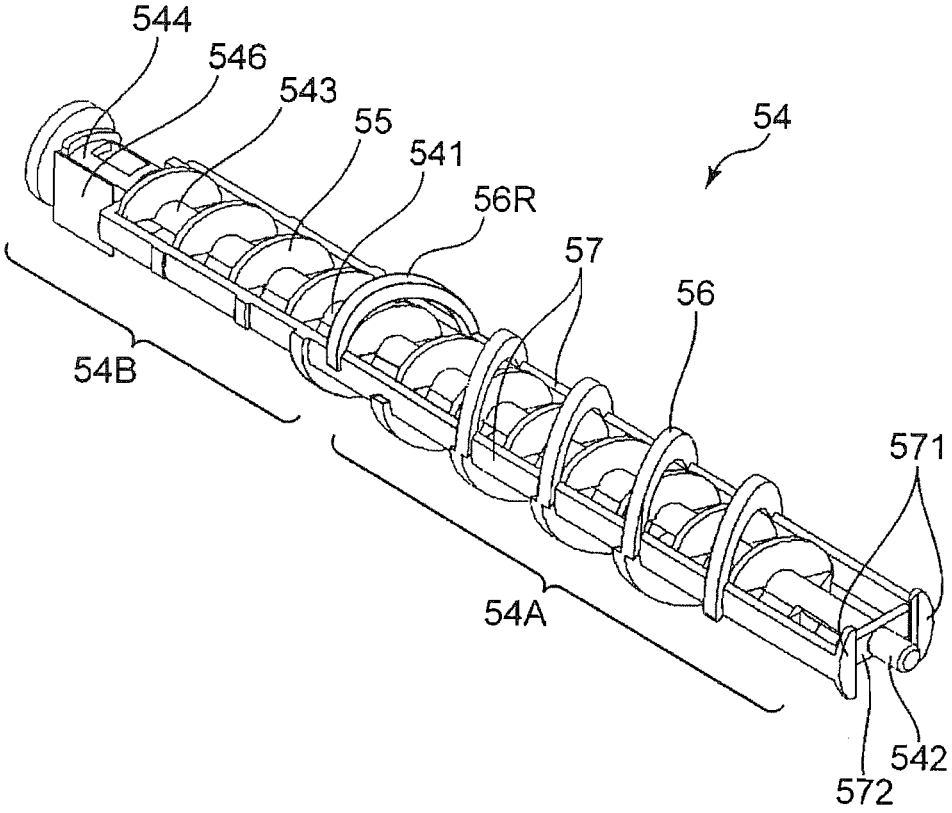
FIG. 10 is a perspective view of a rotating unit located in the toner container.
Figure 11:
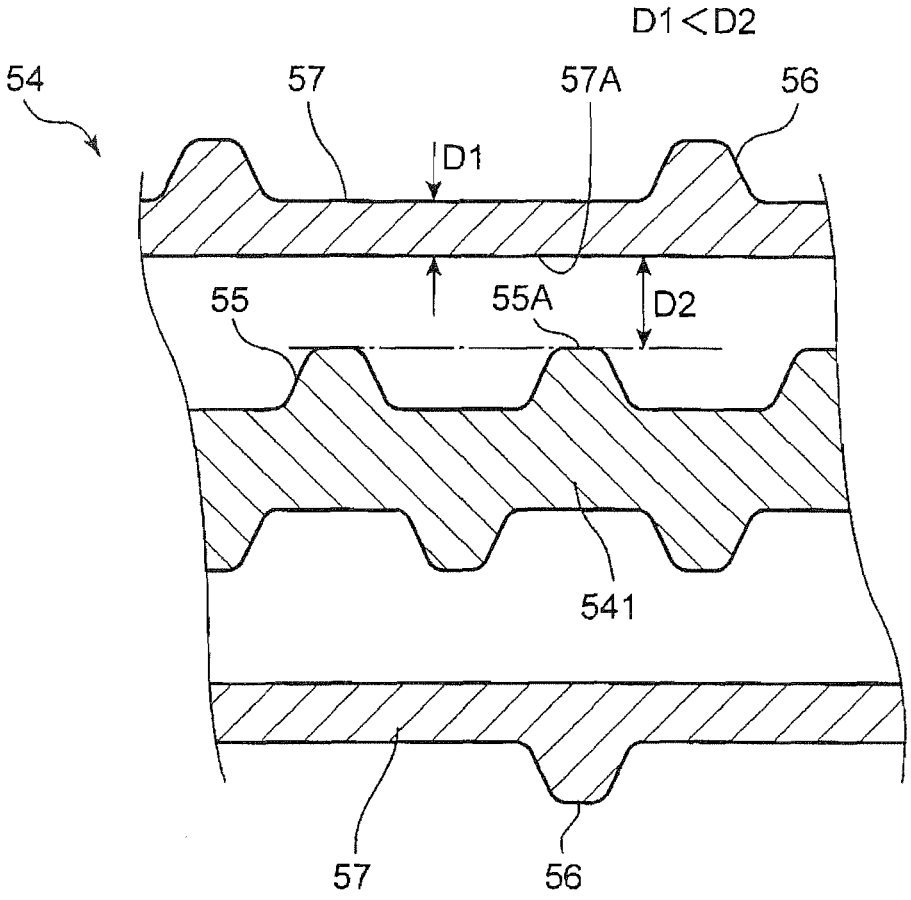
FIG. 11 is a partial sectional view of the rotating unit.

Next, with reference to FIG. 6 to FIG. 11, the structure of a toner container 50 of an embodiment will be described. FIG. 6 is a perspective view of the toner container 50 as viewed from the cylindrical portion 52 side (the rear in FIG. 1). FIG. 7 is a perspective view of the toner container 50 viewed from a direction opposite to that of FIG. 6, and specifically viewed from the lid member 53 side. FIG. 8 is a side view of the toner container 50. FIG. 9 is a sectional side view of same. FIG. 10 is a perspective view of a rotating unit 54 positioned in the toner container 50. FIG. 11 is a partial sectional view of the rotating unit.

As described above, the toner container 50 includes a main body 51, a cylindrical portion 52, a lid member 53 (fourth side wall), and a rotating unit 54. In order to define a space where toner is stored, the main body 51 has a bottom wall 511 that is semicircular in cross-section, a first side wall 512 that extends upwardly from one end edge of the bottom wall 511, a second side wall 513 that extends upwardly from the other end edge of the bottom wall 511 and faces the first side wall 512, a third side wall 514 that connects the cylindrical portion 52 side edges of the first side wall 512 and the second side wall 513, a top wall 515 that connects the upper edges of the first side wall 512 and the second side wall 513, and a first flange portion 516 formed on the edge facing the lid member 53. The main body 51 has a side opening on the first flange portion 516 side thereof.

The main body 51 has such a vertically long external shape that the distance between the first side wall 512 and the second side wall 513 increases from the bottom wall 511 toward the top. The first side wall 512 and the second side wall 513 are flat plate-like members, and the first side wall 512 and the second side wall 513 have inner surfaces that are linear in cross-section.

A cap 517 that covers an opening for filling the main body 51 with toner is attached to the upper part of the third side wall 514. A wireless tag 518, in which management information of the toner container 50 is recorded, is attached to the second side wall 513. Near the upper ends of the first side wall 512 and the second side wall 513, a pair of grooves 519 parallel to the direction in which the bottom wall 511 extends are formed. The grooves 519 are guided by guide members (not shown) on the main body housing 10 side when the toner container 50 is connected to the main body housing 10.

The cylindrical portion 52 is a cylindrical portion that extends from the third side wall 514 and connects to the bottom wall 511. A first end portion 523 of the cylindrical portion 52 is connected to the upper end of the third side wall 514, and the internal space within the main body 51 and the internal space within the cylindrical portion 52 communicate with each other. A second end portion 524 extends from the cylindrical portion 52 and the container gear 54G is positioned so as to extend outward from the second end portion 524. The bottom portion 525 of the cylindrical portion 52 is flush with the bottom wall 511 of the main body 51, and thus a portion that is semicircular in cross-section is formed between the first flange portion 516 and the second end portion 524. The cylindrical portion 52 has an inner wall surface that is circular in cross-section in the radial direction of the rotation axis 541, and is slightly tapered from the first end portion 523 toward the second end portion 524.

As described above, the cylindrical portion 52 includes a discharge port 521, and the cylindrical portion 52 is attached to the developing unit 33. The discharge port 521 is a drop opening located in the bottom portion 525 (lower surface) of the cylindrical portion 52. An engaging portion 526 that engages with part of the housing 60 at the time of the above-described attachment is disposed on the bottom portion 525. Toner stored in the main body 51 is sent out to the cylindrical portion 52 by rotationally driving a rotating unit 54 (described later) and is discharged through the discharge port 521. The cylindrical portion 52 has an inner wall surface that is circular in cross-section and corresponds to the rotation locus of the most radially extending part of the rotating unit 54 (second transport member 56).

As shown in FIG. 9, the discharge port 521 is positioned in the vicinity of the second end portion 524 of the bottom portion 525. A shutter plate 527 that slides along the direction in which the cylindrical portion 52 extends is attached to the lower surface of the discharge port 521. The shutter plate 527 is urged by an urging member (not shown) in the direction to the second end portion 524 so as to always cover the discharge port 521. When the cylindrical portion 52 is attached to the developing unit 33, the shutter plate 527 interferes with part of the housing 60 and slides in the direction to the first end portion 523. FIG. 9 shows a state where the shutter plate 527 is retracted and opening the discharge port 521. The shutter plate 527 and the above-described engaging portion 526 are integral with each other.

The lid member 53 covers the side opening of the main body 51, and has a lid main body portion 531 having a recessed shape, and a second flange portion 532 provided on the periphery of the lid main body portion 531 and abutting the first flange portion 516. The lid main body portion 531 has an inclined surface that bulges upwardly, and a vertical surface connecting to the upper end of the inclined surface. The vertical surface of the lid main body portion 531 is located in a part extending from the second flange portion 532. The user can pinch the part and attach and detach the toner container 50 to and from the main body housing 10. At the lower end of the inner surface of the lid main body portion 531, a rotatably supporting portion 533 that rotatably supports a first end portion 542 of the rotating shaft of the rotating unit 54 (described later) is provided. The first end portion 542 is inserted into the rotatably supporting portion 533, and the second flange portion 532 is welded to the first flange portion 516.

The rotating unit 54 is positioned across the bottom wall 511 of the main body 51 and the cylindrical portion 52, is rotationally driven about its axis, and thereby transports toner. As shown in FIG. 9 and FIG. 10, the rotating unit 54 has a rotating shaft 541, and a first transport member 55, a second transport member 56, and a pair of dispersing members 57 that rotate integrally with the rotating shaft 541.

The rotating shaft 541 is located so as to extend in the direction in which the bottom wall 511 extends, and has a first end portion 542 and a second end portion 543 at both ends thereof. The first end portion 542 is rotatably supported by the rotatably supporting portion 533 of the lid member 53. A tubular holding piece 544 (holding piece) is integrally attached to the second end portion 543. By fitting a body portion 545 of the container gear 54G into the tubular holding piece 544, the container gear 54G and the rotating shaft 541 are integrated. The body portion 545 is rotatably supported by the second end portion 524 of the cylindrical portion 52.

A flexible film 546 (flexible pressing member) that moves toner to the discharge port (drop opening) is attached to the tubular holding piece 544. The film 546 is a rectangular thin PET film, extending in a direction perpendicular to the axial direction of the rotating shaft 541, and is attached to the circumferential surface of the tubular holding piece 544. When the rotating shaft 541 rotates, the film 546 moves around the tubular holding piece 544, fluidizes toner existing in the vicinity of the second end portion 524 of the cylindrical portion 52, and moves the toner to the discharge port 521.

The first transport member 55 is a transport member that is integral with the rotating shaft 541 and spirally protruding from the circumferential surface of the rotating shaft 541. The second transport member 56 is a hollow spiral transport member that is positioned around the rotating shaft 541, leaving a gap between it and the rotating shaft 541 and the first transport member 55. That is, the second transport member 56 is located over the circumferential surface of the rotating shaft 541 and on the radially outer side of the first transport member 55. The pair of dispersing members 57 are rod-like members that are about the same length as the rotating shaft 541 and are positioned parallel to the rotating shaft 541 and connect the side portions of the second transport member 56. The pair of dispersing members 57 are spaced 180 degrees apart in the circumferential direction of the rotating shaft 541.

In other words, the second transport member 56 is formed of a plurality of semicircular arch-like transport pieces, these arch-like transport pieces are integrated by the pair of dispersing members 57, and as a result, a spiral second transport member 56 having a hollow portion near the axis thereof is formed. The internal diameter of the hollow portion of the second transport member 56 is greater than the external diameter of the spiral of the first transport member 55. The rotating shaft 541 having the first transport member 55 on the circumferential surface thereof is inserted concentrically into this hollow portion. The rotating unit 54 of this embodiment is configured in such a manner. The direction of the spiral of the first transport member 55 is opposite to the direction of the spiral of the second transport member 56.

A spiral piece 56R that is a semicircular arch-like transport piece is attached to the second end portion 543 side (the cylindrical portion 52 side end) of the second transport member 56. The spiral piece 56R is substantially the same size as the arch-like transport pieces of the second transport member 56. The spiral piece 56R is attached between the pair of dispersing members 57 such that the direction of the spiral thereof is opposite to that of the arch-like transport pieces of the second transport member 56.

The pair of dispersing members 57 are connected at their ends 571 by a connecting piece 572. The connecting piece 572 is fixed, in its middle part, to part of the rotating shaft 541 near the first end portion 542. Although not shown in FIG. 10, the same connecting piece is located on the side of the second end portion 543. That is, the rotating shaft 541, the second transport member 56, and the dispersing members 57 are integrated by the connecting pieces 572, and when the rotating shaft 541 rotates, the second transport member 56 and the dispersing members 57 also rotate integrally therewith.

The rotating unit 54 (rotating shaft 541) is provided so as to straddle the main body 51 and the cylindrical portion 52. As shown in FIG. 10, the rotating unit 54 includes a first portion 54A located in the main body 51 and a second portion 54B located in the cylindrical portion 52. The first transport member 55 is formed over substantially the entire length of the rotating shaft 541 in the axial direction. That is, the first transport member 55 is formed on the circumferential surface of part of the rotating shaft 541 corresponding to both the first portion 54A and the second portion 54B. On the other hand, the second transport member 56 is positioned only in the region corresponding to the first portion 54A. The spiral piece 56R is located in part of the first portion 54A bordering the second portion 54B, so as to be connected to the end of the second transport member 56. The dispersing members 57 are positioned so as to straddle the first portion 54A and the second portion 54B.

An example of the rotating unit 54 will be described with reference to FIG. 11. FIG. 11 is a partial sectional view of the rotating unit 54. An embodiment concerning the relationship between the thickness of the dispersing members 57 and the distance between the outermost circumference of the spiral of the first transport member 55 and the radially inner surface of the pair of dispersing members 57 will be shown. The thickness of the dispersing members 57 in the radial direction of the rotating shaft 541 is denoted by D1. The distance between the outermost circumferential part 55A of the spiral of the first transport member 55 and the radially inner surface 57A of the pair of dispersing members 57 is denoted by D2.

In this case, it is preferable that the distance D2 is greater than the thickness D1 (D1<D2). Since the distance D2 is greater than the thickness D1, a sufficient space exists between the outermost circumferential part 55A of the spiral of the first transport member 55 and the radially inner surface 57A of the pair of dispersing members 57. Thus, the region where toner is transported by the first transport member 55 is sufficiently secured in the hollow portion of the spiral of the second transport member 56. Thus, the first transport member 55 easily transports toner in the hollow portion.

When a rotational drive force that rotates the rotating shaft 541 in a predetermined rotation direction is applied to the container gear 54G, the first transport member 55 and the second transport member 56 generate toner-transporting forces corresponding to their respective spiral directions. The second transport member 56 transports toner in a direction from the main body 51 toward the cylindrical portion 52 (discharge port 521) (hereinafter referred to as "second transport direction"). That is, the second transport member 56 transports toner from the first end portion 542 of the rotating shaft 541 to the second end portion 543 thereof. On the other hand, the first transport member 55 transports toner in a direction from the cylindrical portion 52 to the main body 51 (hereinafter referred to as "first transport direction"). That is, the first transport member 55 transports toner from the second end portion 543 of the rotating shaft 541 to the first end portion 542 thereof.

The dispersing members 57 serve to disperse toner transported by the first transport member 55 and the second transport member 56, in the radial direction of the rotating shaft 541. That is, the dispersing members 57 disperse toner existing around the toner propelled by the spirals of the first transport member 55 and the second transport member 56, in the radial direction. Thus, the movement of toner in the first transport direction or the second transport direction is encouraged.

Since the spiral piece 56R is located in a direction opposite to the direction of the spiral of the second transport member 56, the spiral piece 56R transports toner in the first transport direction. In the vicinity of the border between the main body 51 and the cylindrical portion 52, the spiral piece 56R generates a transporting force that actively returns toner from the cylindrical portion 52 to the toner main body.

Figure 12:
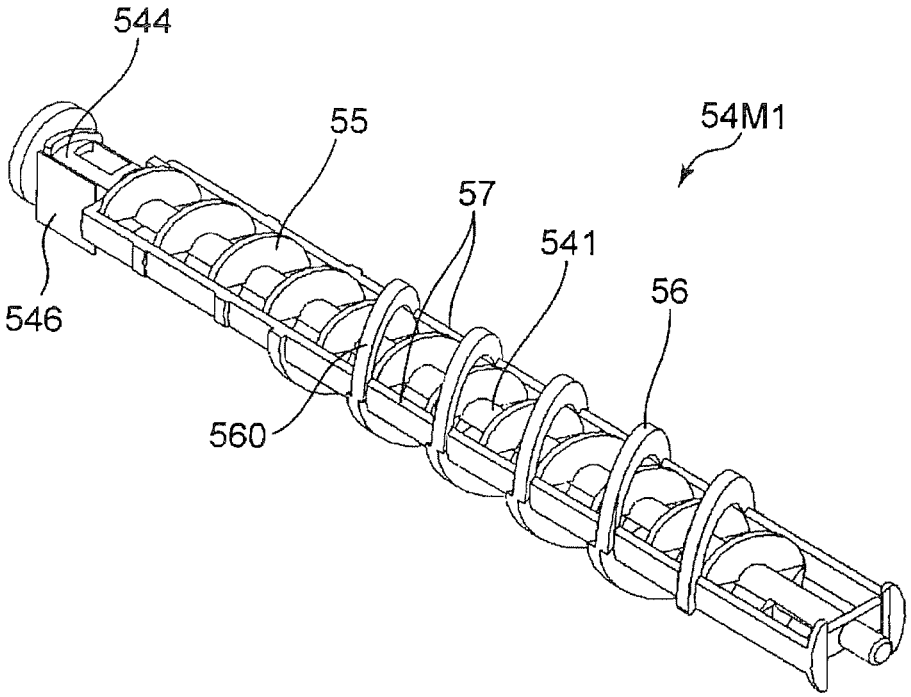
FIG. 12 is a perspective view showing a rotating unit according to another embodiment.

A rotating unit having no spiral piece 56R may be used. FIG. 12 is a perspective view showing a rotating unit 54M1 according to another embodiment. In the rotating unit 54M1, arch-like transport pieces 560 forming the spiral of the second transport member 56 are located up to the position where the spiral piece 56R exists in FIG. 10. That is, in the rotating unit 54M1, the spiral of the second transport member 56 is formed throughout the first portion 54A. The toner transport operation by the first transport member 55 and the second transport member 56 is the same as that of the rotating unit 54 of FIG. 10.

Figure 13:
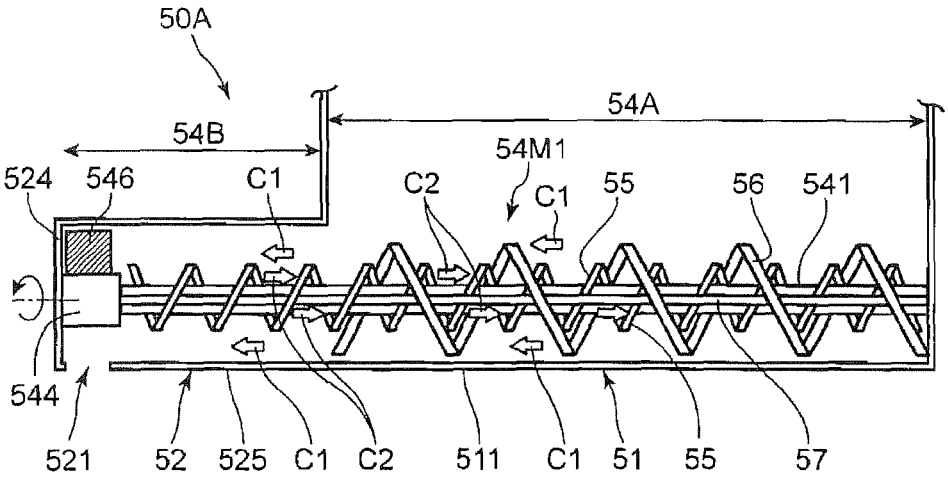
FIG. 13 is a schematic sectional side view of a toner container, illustrating the toner transport operation by the rotating unit.
Figure 14:
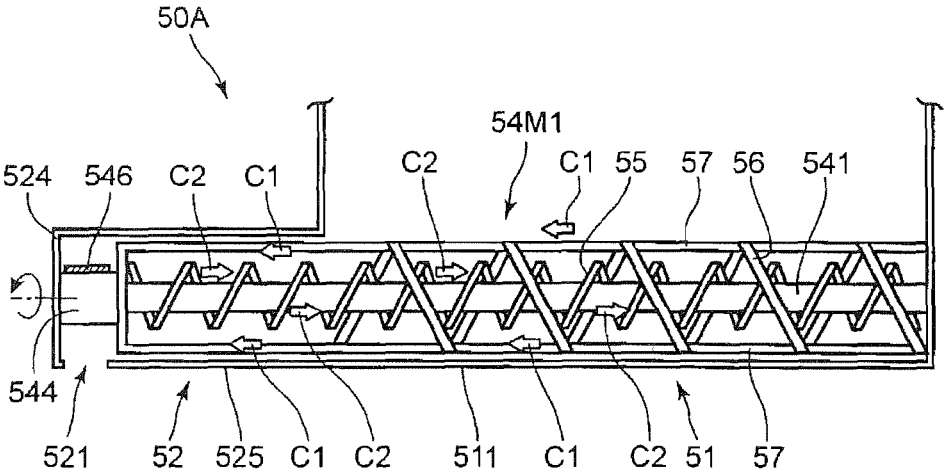
FIG. 14 is a schematic sectional side view of the toner container with the rotating unit rotated 90 degrees with respect to FIG. 13.

As described above, in the rotating unit 54 (54M1) of this embodiment, the radially inner portion (the first transport member 55) and the radially outer portion (the second transport member 56) transport toner in different directions. First, the toner transport operation by the rotating unit 54M1 shown in FIG. 12 will be described with reference to FIG. 13 and FIG. 14. FIG. 13 is a schematic sectional side view of a toner container 50A, for illustrating the toner transport operation by the rotating unit 54M1. FIG. 14 is a schematic sectional side view of the toner container 50A with the rotating unit 54M1 rotated 90 degrees from the state of FIG. 13.

The second transport member 56 is rotationally driven and thereby applies a pressing force in the second transport direction to toner. Toner that moves toward the cylindrical portion 52 due to the second transport member 56 moves exclusively in the vicinity of the outer circumference of the rotating unit as shown by arrows C1 in the figures. The second transport member 56 does not exist in the cylindrical portion 52. However, the dispersing members 57 existing in about the same orbit as the second transport member 56 in the radial direction of the rotating shaft 541 cause the toner near the inner circumferential wall of the cylindrical portion 52 to flow and thus the force that propels toner in the second transport direction is maintained. Thus, also in the cylindrical portion 52, in a part near the inner wall thereof, toner moves toward the second end portion 524 as shown by arrows C1.

Toner transported in the second transport direction finally reaches the second end portion 524 of the cylindrical portion 52. Being pressed by the film 546, part of toner that has reached falls through the discharge port 521 into the housing 60.

Toner that has not been discharged through the discharge port 521 is reversely transported by the driving of the first transport member 55, as shown by arrows C2 in the figures, exclusively in the part of the cylindrical portion 52 near the central axis, in the first transport direction. The reversely transported toner passes across the border between the cylindrical portion 52 and the main body 51, and while being dispersed in the radial direction (the direction toward the central axis) by the dispersing members 57, the toner is returned to the main body 51.

As described above, the toner container 50 (50A) of this embodiment has such a circulation movement that toner sent out to the cylindrical portion 52 by the second transport member 56 is returned to the main body 51 by the first transport member 55. For this reason, even in a toner container 50 in which a discharge port 521 is located at the distal end of a cylindrical portion 52, toner can be prevented from clumping in the vicinity of the discharge port 521.

The cylindrical portion 52 has a tubular internal space that has an internal diameter slightly greater than the external diameter of the spiral of the second transport member 56. In the case where in a toner container 50 having such a cylindrical portion 52, the rotating unit 54 only transports toner in the second transport direction, and if the amount of discharged toner is less than the amount of moved toner, toner is trapped and packed in the cylindrical portion 52 and finally clumps. Clumps of toner block the discharge port 521, thereby preventing toner from being discharged.

In the toner container 50 of this embodiment, the first transport member 55 is positioned in the cylindrical portion 52 and reversely transports toner in the first transport direction, and thus toner is not packed. In the cylindrical portion 52, toner cannot move radially outward, and thus toner tries to move toward the axis of the cylindrical portion 52. In the axis part, the first transport member 55 is positioned and transports toner in the first transport direction. Thus, before toner clumps, toner can be efficiently returned from the cylindrical portion 52 to the main body 51.

Figure 15:
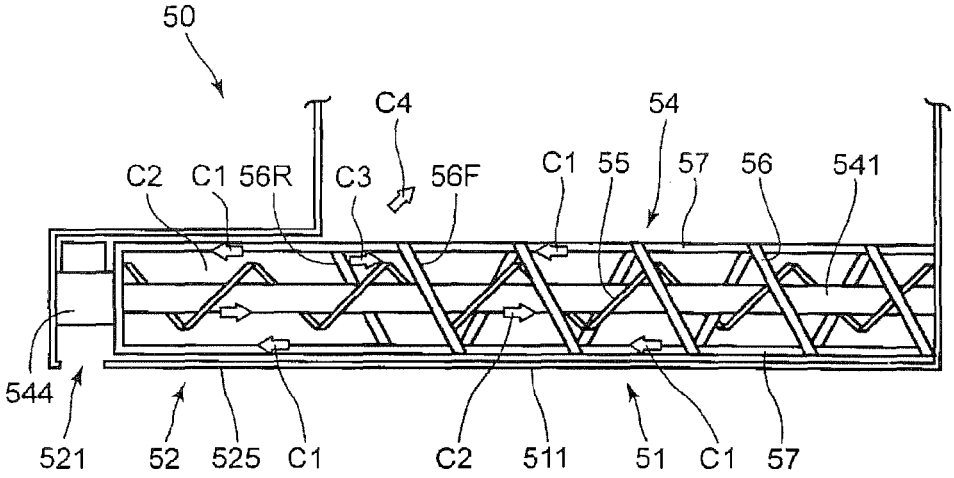
FIG. 15 is a schematic sectional side view of a toner container, illustrating the toner transport operation by a rotating unit.

The above-described circulation movement is promoted in the case where a rotating unit 54 having the spiral piece 56R shown in FIG. 10 is used. FIG. 15 is a schematic sectional side view of a toner container 50, for illustrating the toner transport operation by the rotating unit 54 of FIG. 10. The toner transport operation by the first transport member 55 and the second transport member 56 is the same as the operation described with reference to FIG. 13 and FIG. 14.

In the cylindrical portion 52, the outward movement of toner in the radial direction of the rotating shaft 541 is limited. Also in the vicinity of the border between the cylindrical portion 52 and the main body 51, the movement of toner is limited compared to the toner in the main body 51. In the vicinity of the border, the spiral piece 56R can generate a pressing force in the direction of arrow C3 that sends out toner from the cylindrical portion 52 to the main body 51. Toner pushed back in the direction of arrow C3 is dispersed by the dispersing members 57, as shown by arrow C4, in the radial direction of the rotating unit 54. Thus, in the vicinity of the border, the collision between toner transported forward in the second transport direction by the second transport member 56 and toner transported reversely in the first transport direction by the first transport member 55 is reduced, and toner can be smoothly returned from the cylindrical portion 52 to the main body 51.

Figure 16:
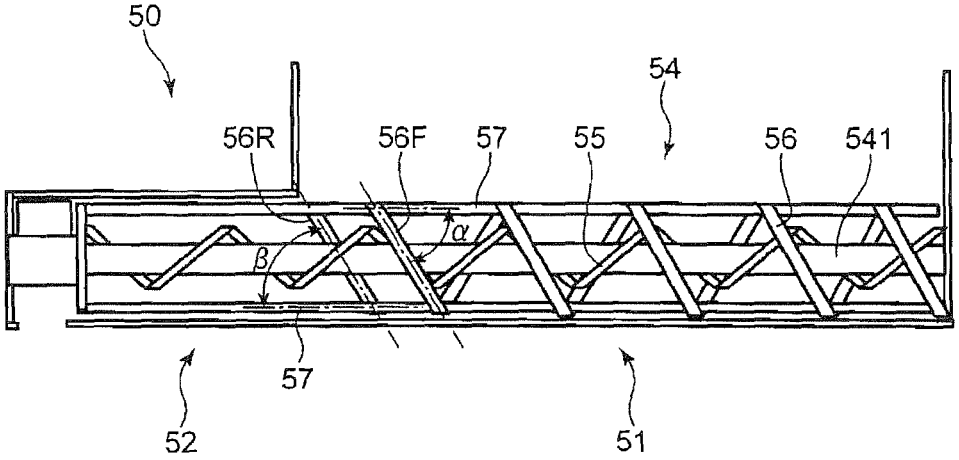
FIG. 16 is a schematic sectional side view of the toner container, illustrating a preferable angle of the spiral.

An arrangement of the spiral piece 56R will be described. In order to cause the spiral piece 56R to optimally generate a transporting force that returns toner from the cylindrical portion 52 to the main body 51, it is important that the spiral piece 56R is inclined at an appropriate angle. As shown in FIG. 16, in the side view of the rotating unit 54, when the acute angle between the spiral of the second transport member 56 (the spiral part 56F adjacent to the spiral piece 56R and closest to the cylindrical portion 52) and the dispersing members 57 extending parallel to the rotating shaft 541 is α, and the angle between the spiral piece 56R and the dispersing members 57 is β, it is preferable that the following expression be satisfied:

$$\alpha>\beta>0.7\alpha \quad (1)$$

In the above expression (1), when the relationship α>β is satisfied, the amount of toner that the spiral piece 56R can transport per revolution of the rotating unit 54 is greater than the amount of toner that the spiral (spiral part 56F) of the second transport member 56 can transport per revolution of the rotating unit 54. This is due to the fact that the pitch of the spiral piece 56R in the axial direction of the rotating shaft 541 is longer than that of the spiral part 56F. Thus, in the vicinity of the border, the transporting force in the first transport direction (the force that returns developer) is greater than the transporting force in the second transport direction. In the above expression (1), when the relationship β>0.7α is satisfied, the angle of the spiral piece 56R is not too small, and a shortage of transporting force in the first transport direction is avoided.

The inclination angle α of the spiral of the second transport member 56 needs to be neither too steep nor too gradual in order to achieve appropriate transportation in the second transport direction. The range of the preferable inclination angle α is at least 45 degrees but no more than 80 degrees, and is more preferably at least 55 degrees but no more than 70 degrees. The inclination angle β of the spiral piece 56R is set in relation to such a preferable inclination angle α so as to satisfy the above expression (1).

The results of an experiment with respect to the appropriate inclination angle 3 of the spiral piece 56R is set forth below. A toner container 50 shown in FIG. 9 was made of the following components:

cylindrical portion 52; internal diameter=17 mm, length=45 mm main body 51; width of part communicating with cylindrical portion 52=17 mm, length=100 mm first transport member 55; external diameter=9 mm, pitch=10 mm, external diameter of rotating shaft 541=5 mm second transport member 56; maximum external diameter=21 mm, minimum external diameter=16 mm, internal diameter=14 mm, pitch=20 mm, external diameter decreases toward cylindrical portion 52. Inclination angle α of spiral was set to 62.2 degrees.

dispersing members 57; width in circumferential direction=1 mm spiral piece 56R; external diameter=18 mm, internal diameter=14 mm. Seven different inclination angles β: 68.5 degrees, 62.2 degrees, 56.7 degrees, 51.7 degrees, 47.4 degrees, 43.5 degrees, and 40.2 degrees were prepared. (The inclination angle β is determined by the length of the pitch.)

The cylindrical portion 52 of the above-described toner container 50 was filled with 4.3 grams of yellow toner, and the main body 51 was filled with 100 grams of black toner. The rotating unit 54 was rotated for 15 minutes with the discharge port 521 closed. After that, part of toner was obtained from the upper layer of toner contained in the main body 51, and the density (L-value) thereof was measured with a Macbeth reflection densitometer RD-191 (manufactured by Macbeth). The same measurement was carried out on seven toner containers 50 that differ in the inclination angle β of the spiral piece 56R as described above. The results are shown in Table 1 and FIG. 17.

TABLE 1

| | Pitch of spiral piece 56R | | | | | | |
|---|---|---|---|---|---|---|---|
| | 15 | 20 | 25 | 30 | 35 | 40 | 45 |
| Angle (β) | 68.5 | 62.2 | 56.7 | 51.7 | 47.4 | 43.5 | 40.2 |
| Angle ratio (β/α) | 1.1 | 1 | 0.91 | 0.831 | 0.761 | 0.699 | 0.646 |
| L-value | 13 | 13.01 | 13.73 | 13.94 | 13.5 | 13.01 | 13.01 |

Figure 17:
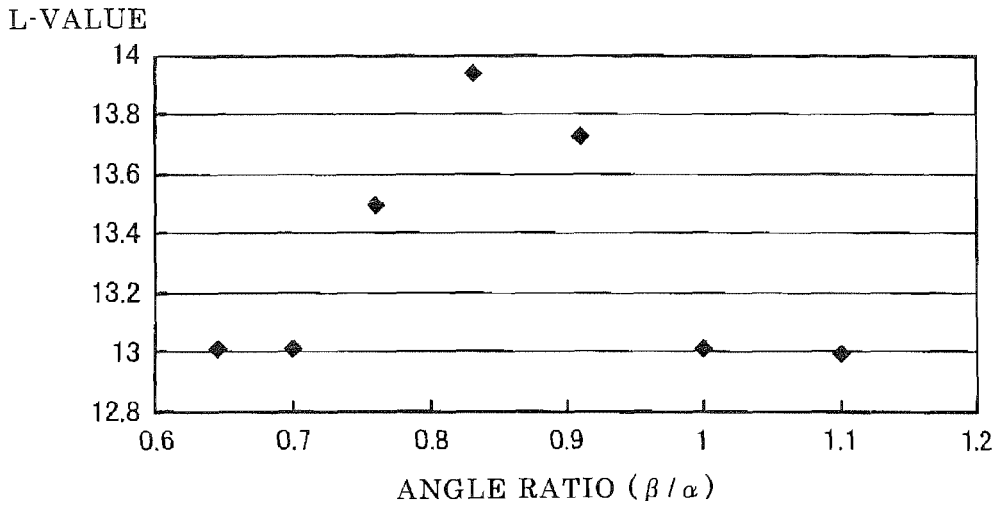
FIG. 17 is a graph evaluating the return of toner from the cylindrical portion to the main body.

As is clear from Table 1 and FIG. 17, in toner containers 50 in which the inclination angle β of the spiral piece 56R is 56.7 degrees, 51.7 degrees, and 47.4 degrees, that is, β/α is within the range of 0.7 to 1.0, the L-values were high. This demonstrates that the yellow toner filling the cylindrical portion 52 was returned to the main body 51 and mixed with black toner, and as a result, the lightness increased. In the other toner containers, the L-values were low, so it can be seen that the amount of yellow toner mixed with black toner in the main body 51 was small. From the above experimental results, it was confirmed that the inclination angle β is preferably set within the range of the above expression (1).

According to the embodiment described above, in a toner container 50 having a container shape including a main body 51 and a cylindrical portion 52 extending from the main body 51 and having a discharge port 521, toner can be prevented from clumping in the cylindrical portion 52. Thus, a toner container 50 that can supply toner stored in a main body 51 to the developing unit 33 such that a little toner remains in the main body, can be provided.

Although a toner container 50 and an image forming apparatus 1 according to the previous embodiment of the present disclosure has been described, the present disclosure is not limited thereto. For example, the following other embodiments can be made.

(1) In the previous embodiment, a toner container 50 is shown as a specific example of a developer case. Examples of developer cases include a developing unit that combines a toner reservoir, a developing roller, and others, and an intermediate hopper interposed between a toner container and a developing unit.

Figure 18:
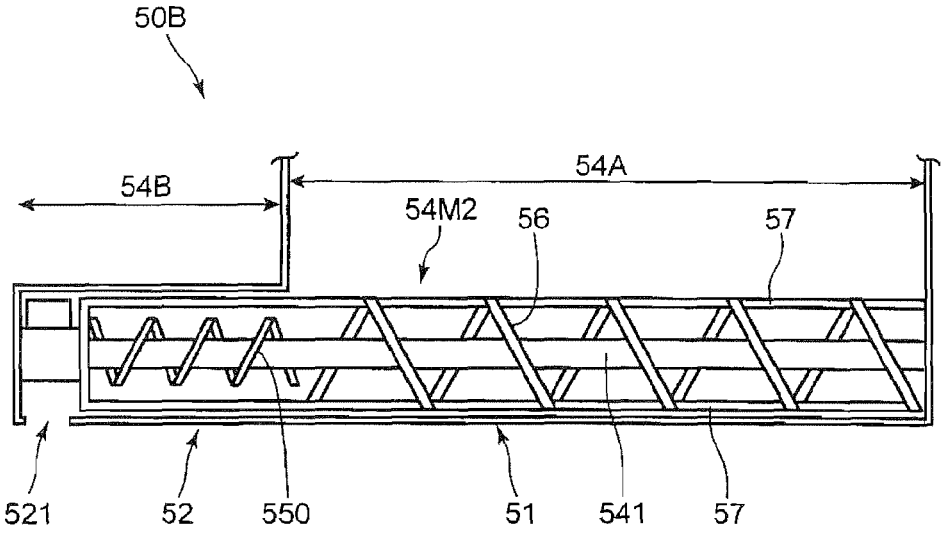
FIG. 18 is a schematic sectional side view of a toner container having a rotating unit according to another embodiment.
Figure 19:
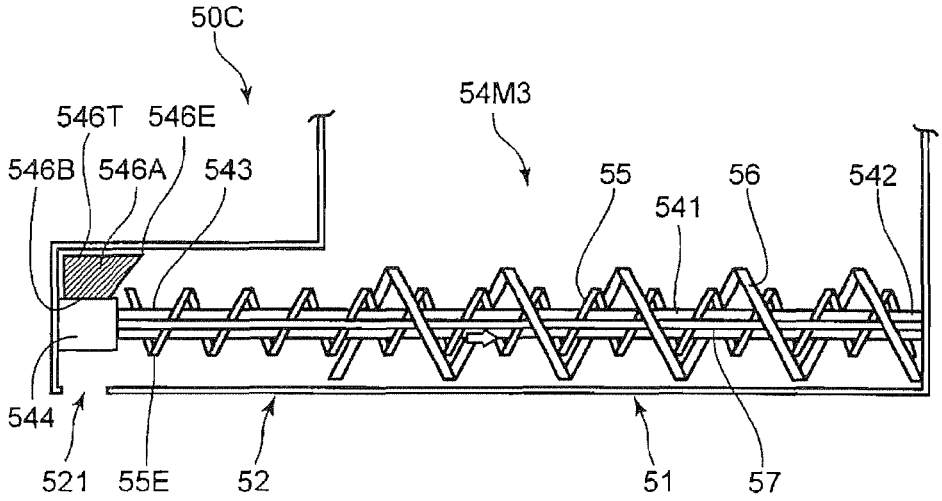
FIG. 19 is a schematic sectional side view of a toner container, showing another embodiment of a film.

(2) In the previous embodiment, an example in which the first transport member 55 is formed over the entire length of the rotating shaft 541 in the axial direction is shown. The first transport member 55 is formed at least in the second portion 54B of the rotating shaft 541. FIG. 18 is a schematic sectional side view of a toner container 50B having a rotating unit 54M2 according to another embodiment. As shown, the first transport member 550 is formed on the circumferential surface of the rotating shaft 541, only in the second portion 54B corresponding to the cylindrical portion 52 of the toner container 50B. As in the above-described embodiment, the second transport member 56 is positioned only in the first portion 54A corresponding to the main body 51. Even in the rotating unit 54M2 having such a configuration, the first transport member 550 returns toner from the cylindrical portion 52 to the main body 51, and thus toner can be prevented from clumping in the cylindrical portion 52.

(3) In the previous embodiment, an example in which a rectangular film 546 is attached to the end of the rotating shaft 541 of the rotating unit 54 is shown. Instead of this, a rotating unit 54M3 to which a trapezoidal film 546A is attached, such as that shown in FIG. 19, may be used. The film 546A has a base end portion 546B attached to the tubular holding piece 544 and a free end portion 546T on the side opposite to the base end portion 546B. The length of the free end portion 546T in the axial direction of the rotating shaft 541 is greater than that of the base end portion 546B. Part of the free end portion 546T (extension portion 546E) is located over the second end portion 543 of the rotating shaft 541.

Actually, it is difficult to form the spirals of the first transport member 55 and the second transport member 56 such that they extend to the immediate vicinity of the second end portion 543 of the rotating shaft 541. Thus, in the vicinity of the second end portion 543, there is virtually no member that applies a pressing force to toner, and toner tends to be less fluid. In this case, instead of the rectangular film 546 shown in FIG. 9 and FIG. 10, by using a film 546A having an extension portion 546E, toner can be made more fluid in the vicinity of the second end portion 543. That is, with the rotation of the rotating shaft 541, the extension portion 546E agitates toner in the vicinity of the second end portion 543 and promotes the flow of toner. This facilitates the discharge of toner through the discharge port 521 and the transportation of toner in the first transport direction by the first transport member 55.

Figure 20A:
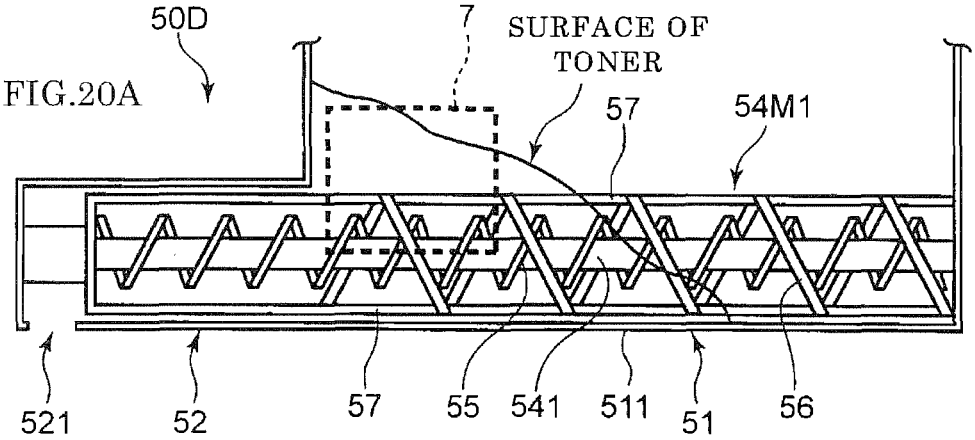
FIGS. 20A and 20B are schematic sectional views of a toner container, showing another embodiment having a toner sensor.
Figure 21:
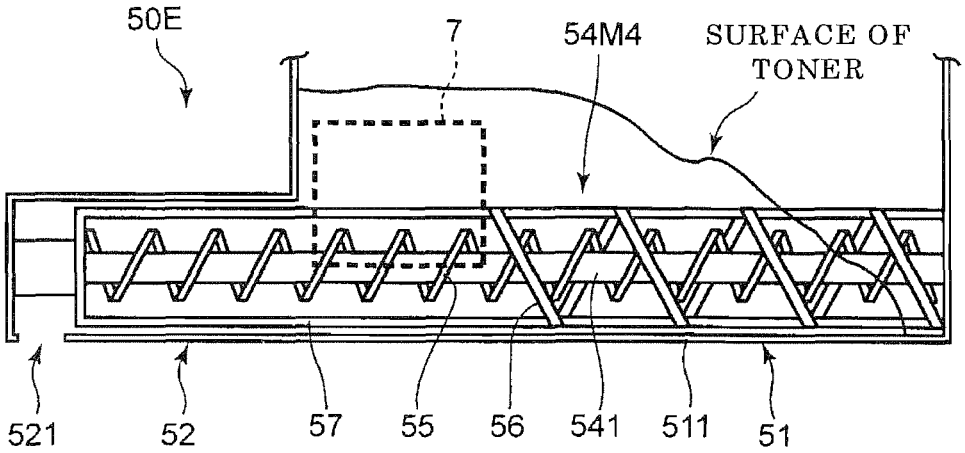
FIG. 21 is a schematic sectional side view of a toner container, showing another embodiment having a toner sensor.

(4) Generally, a toner container is equipped with a toner sensor that detects the remaining amount of toner in the container. Other embodiments in the relationship between the arrangement of the toner sensor and the structure of the rotating unit will be exemplified. FIG. 20A and FIG. 21 are schematic sectional side views of toner containers 50D and 50E, showing other embodiments having toner sensors. The toner container 50D is provided with the rotating unit 54M1 exemplified in FIG. 12. That is, a rotating unit 54M1 in which the spiral of the second transport member 56 is formed over substantially the entire length of the main body 51 in the axial direction, is provided. On the other hand, the toner container 50E shown in FIG. 21 has a rotating unit 54M4 in which the spiral length of the second transport member 56 is relatively short. Specifically, the second transport member 56 is not formed in part of the main body 51 close to the cylindrical portion 52.

Figure 20B:
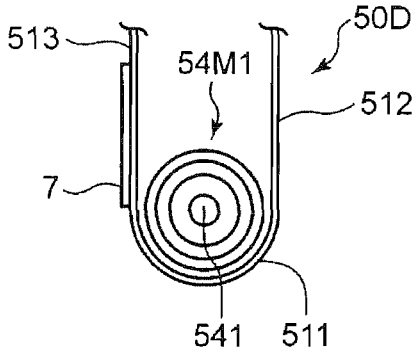

FIG. 20B is a sectional view of the toner container 50D in a direction perpendicular to the axial direction of the rotating shaft 541. As shown in FIG. 20B, a toner sensor 7 that detects the remaining amount of toner is attached to the outer surface of the second side wall 513 of the main body 51 in the vicinity of the border between the main body 51 and the cylindrical portion 52. The toner sensor 7 is a flat plate-like magnetic sensor and outputs a voltage signal corresponding to the remaining amount of toner in the toner container. That is, when toner exists at a position facing the toner sensor 7 (the position shown by dotted line in FIG. 20A and FIG. 21), the toner sensor 7 outputs a high voltage; and when toner does not exist at the position, the toner sensor 7 outputs a low voltage.

In the toner container 50D, when the remaining amount of toner in the container is small, the surface of toner is highest at the cylindrical portion 52 side end of the main body 51 and slopes downwardly as shown in FIG. 20A. On the other hand, in the toner container 50E, when the amount of toner remaining in the container is small, the surface of toner is flat in the part of the main body 51 close to the cylindrical portion 52 as shown in FIG. 21. This is caused by the fact that in the part close to the cylindrical portion 52, the pressing force exerted on toner by the second transport member 56 is relatively weak. In contrast, in the toner container 50D, the pressing force exerted on toner by the second transport member 56 reaches the vicinity of the cylindrical portion 52. Thus, when the toner container 50D becomes close to empty, toner can be caused to flow in a state where there is a difference in height, in the vicinity of the toner sensor 7.

Figure 22:
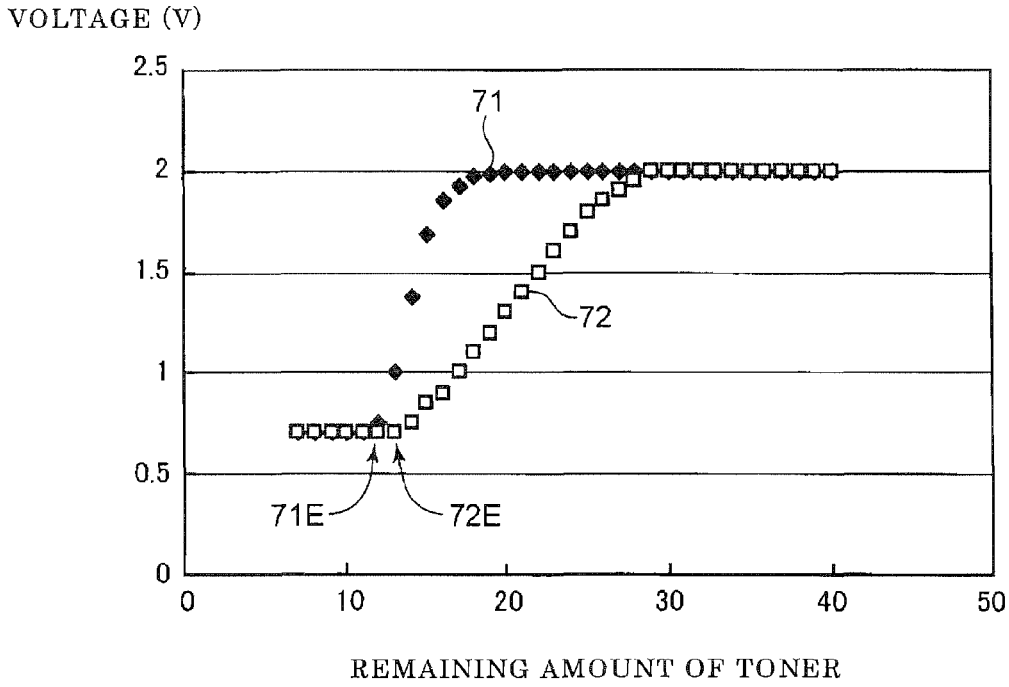
FIG. 22 is a graph showing the sensitivities of the toner sensors of FIG. 20 and FIG. 21.

FIG. 22 is a graph showing the sensitivities of the toner sensors 7 of the above-described toner containers 50D and 50E. The first output curve 71 of the toner sensor 7 of the toner container 50D is flat until the remaining amount of toner becomes considerably small, and then decreases steeply. On the other hand, the second output curve 72 of the toner sensor 7 of the toner container 50E starts to decrease while the remaining amount of toner is relatively large. From this graph, it can be seen that the toner sensor 7 of the toner container 50D is more sensitive than the toner sensor 7 of the toner container 50E in the stage where the remaining amount of toner is small. As is clear from the comparison between the empty levels 71E and 72E, the remaining amount of toner when the toner sensor 7 of the toner container 50D outputs a signal corresponding to "empty" is smaller than the remaining amount of toner when the toner sensor 7 of the toner container 50E outputs a signal corresponding to "empty."

From the above, it is preferable that a rotating unit 54M1 in which the spiral of the second transport member 56 is formed over substantially the entire length of the main body 51 in the axial direction be used as a rotating unit and that the toner sensor 7 be attached to a position where the cylindrical portion 52 side end of the second transport member 56 exists. When the toner container becomes close to empty, toner can be caused to flow in a state where there is a difference in height, in the vicinity of the toner sensor 7, and the sensitivity (resolution) of the toner sensor 7 can be improved.

Figure 23:
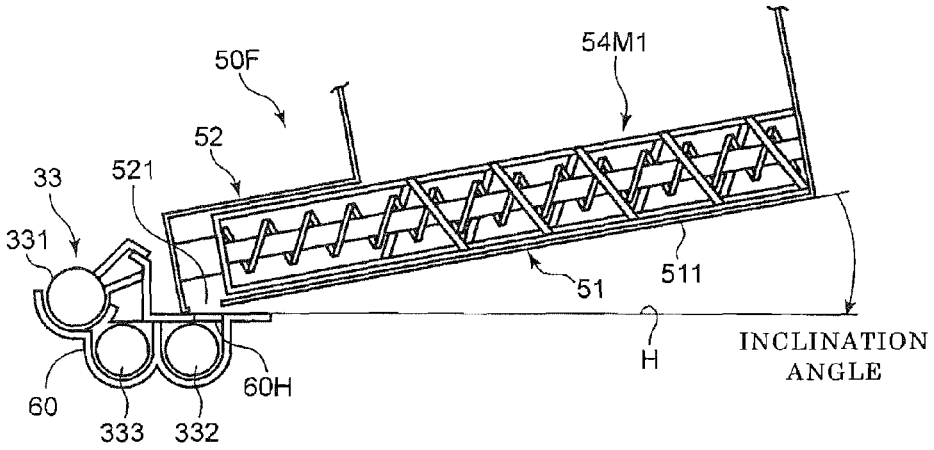
FIG. 23 is a schematic sectional side view of a toner container, showing another embodiment in which a toner container is connected to the developing unit at an angle.

(5) In the previous embodiment, an example in which the toner container 50 is connected horizontally to the developing unit 33 is shown. Instead of this, as shown in FIG. 23, a toner container 50F may be connected to the developing unit 33 at an angle. Specifically, the toner container 50F may be connected to the developing unit 33 with the cylindrical portion 52 having the discharge port 521 lowered and the main body 51 side inclined upwardly. This configuration is preferable because toner can also be guided to the discharge port 521 by gravity.

In this case, it is preferable that the inclination angle of the bottom wall 511 of the toner container 50F with respect to the horizontal direction H be less than the angle of repose of toner contained in the toner container 50F. For example, if the angle of repose of toner is 38 degrees, the inclination angle is preferably less than 35 degrees. This can prevent the transportability of toner in the first transport direction from worsening. When the inclination angle exceeds the angle of repose, the reverse transportation of toner by the first transport member 55 becomes difficult.

Figure 24:
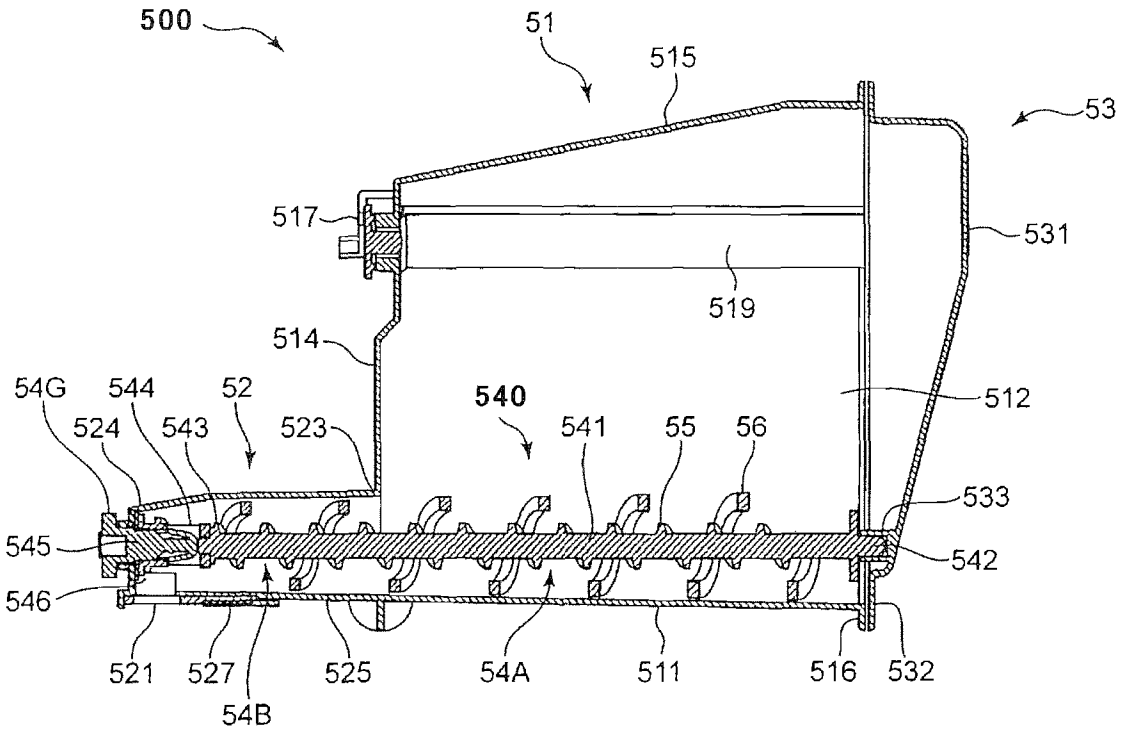
FIG. 24 is a sectional side view of a toner container in another embodiment.
Figure 25:
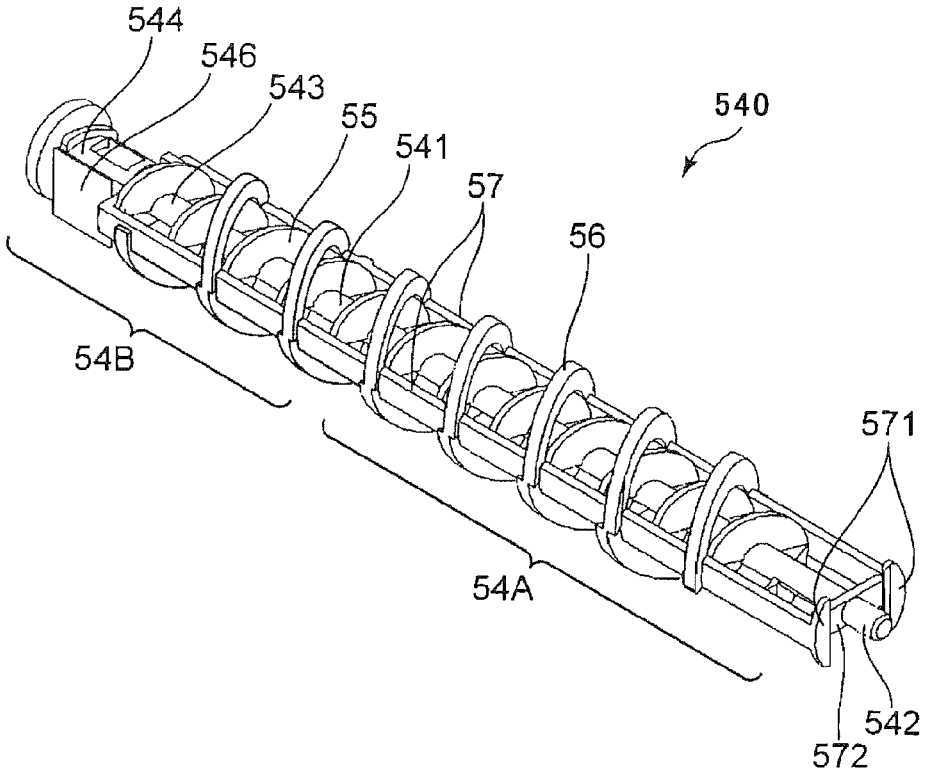
FIG. 25 is a perspective view of a rotating unit disposed in the toner container.
Figure 26:
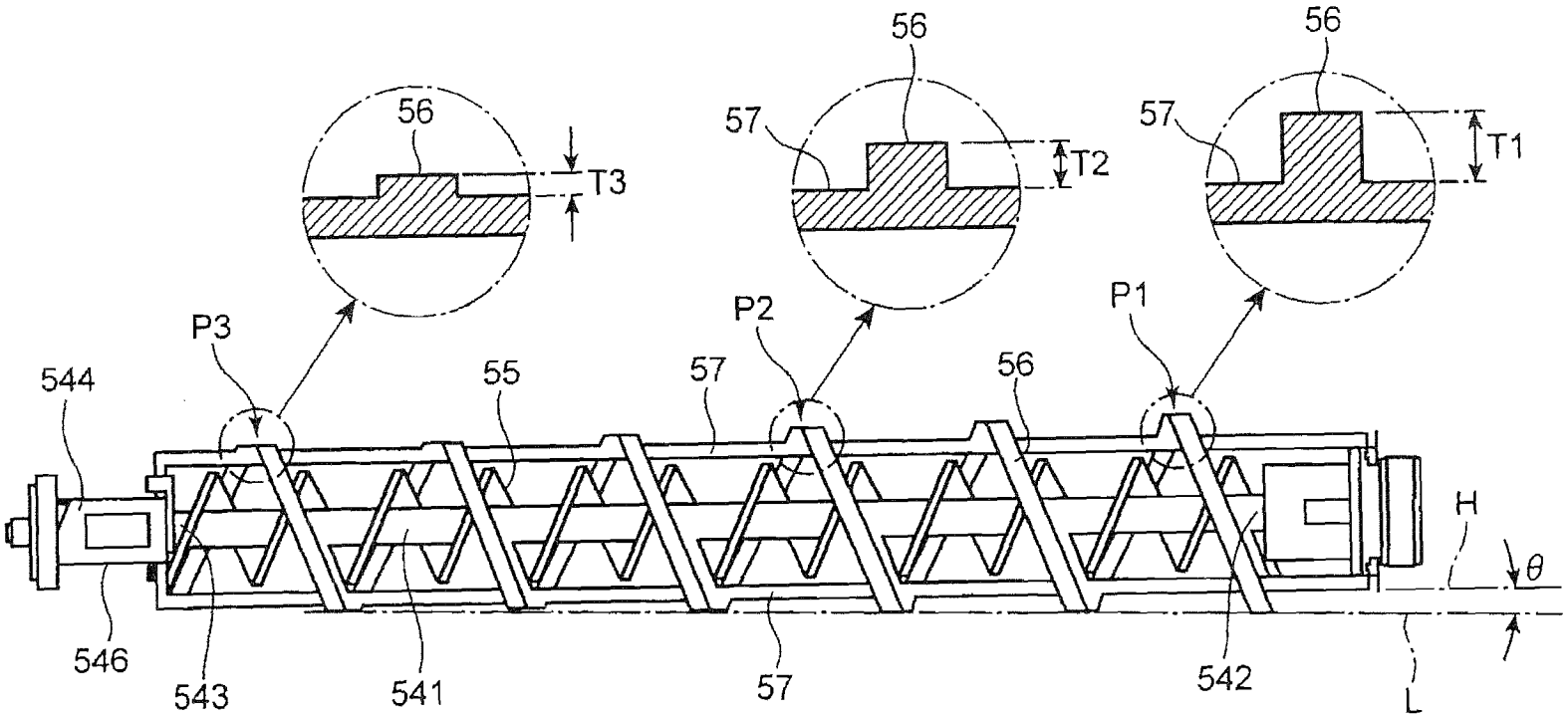
FIG. 26 is a side view of the rotating unit with accompanying partial sectional views.

Next, with reference to FIG. 24 to FIG. 26, the structure of a toner container 500 in another embodiment will be described. FIG. 24 is a sectional side view of the toner container 500, FIG. 25 is a perspective view of a rotating unit 540 located in the toner container 500, and FIG. 26 is a side view of the rotating unit 540 with accompanying partial sectional views. This embodiment is the same as the previous embodiment except for the configuration of the rotating unit of the toner container. So, the same reference numerals will be used to designate the same components as those in the previous embodiment, and the description thereof will be omitted.

As shown in FIG. 24 and FIG. 25, the rotating unit 540 is positioned so as to straddle the main body 51 and the cylindrical portion 52 and includes a first portion 54A located in the main body 51 and a second portion 54B located in the cylindrical portion 52. The first transport member 55 and the second transport member 56 are formed over substantially the entire length of the rotating shaft 541 in the axial direction. That is, the first transport member 55 and the second transport member 56 exist in both the first portion 54A and the second portion 54B. The dispersing members 57 are also positioned so as to straddle the first portion 54A and the second portion 54B.

The external diameter of the spiral of the first transport member 55 is uniform throughout the rotating shaft 541 in the axial direction. On the other hand, the external diameter of the spiral of the second transport member 56 decreases from the first end portion 542 of the rotating shaft 541 toward the second end portion 543 thereof as shown in FIG. 26. Such a reduction in external diameter of the spiral is achieved by changing the thickness of the arch-like transport pieces of the second transport member 56 in the radial direction. On the other hand, the internal diameter of the spiral of the second transport member 56 is uniform over the entire length of the rotating shaft 541 in the axial direction.

In a part P1 near the first end portion 542 of the rotating shaft 541, the thickness of the arch-like transport piece of the second transport member 56 in the radial direction (the extending height from the dispersing members 57) is T1, which is the thickest, as shown in the circle. In a part P2 near the middle of the rotating shaft 541 in the axial direction, the thickness of the arch-like transport piece in the radial direction is T2, which is thinner than T1. In a part P3 near the second end portion 543, the thickness of the arch-like transport piece in the radial direction is T3, which is thinner than T2. That is, T1>T2>T3, and thus the envelope line L of arch-like transport pieces is inclined at an angle θ to the dispersing members 57 extending in the horizontal direction H. In other words, the spiral of the second transport member 56 has a tapered shape that tapers at an angle θ. The cylindrical portion 52 also has a tapered shape that tapers at an angle θ.

When a rotational drive force that rotates the rotating shaft 541 in a predetermined rotation direction is applied to the container gear 54G, the first transport member 55 and the second transport member 56 generate toner-transporting forces corresponding to their respective spiral directions. The second transport member 56 transports toner in a direction from the main body 51 toward the cylindrical portion 52 (discharge port 521). That is, the second transport member 56 transports toner from the first end portion 542 of the rotating shaft 541 to the second end portion 543 thereof. On the other hand, the first transport member 55 transports toner in a direction from the cylindrical portion 52 to the main body 51. That is, the first transport member 55 transports toner from the second end portion 543 of the rotating shaft 541 to the first end portion 542 thereof.

The dispersing members 57 serve to disperse toner transported by the first transport member 55 and the second transport member 56, in the radial direction of the rotating shaft 541. That is, the dispersing members 57 disperse toner existing around the toner propelled by the arch-like transport pieces of the first transport member 55 and the second transport member 56, in the radial direction. Thus, the movement of toner in the first transport direction or the second transport direction is promoted.

Figure 27:
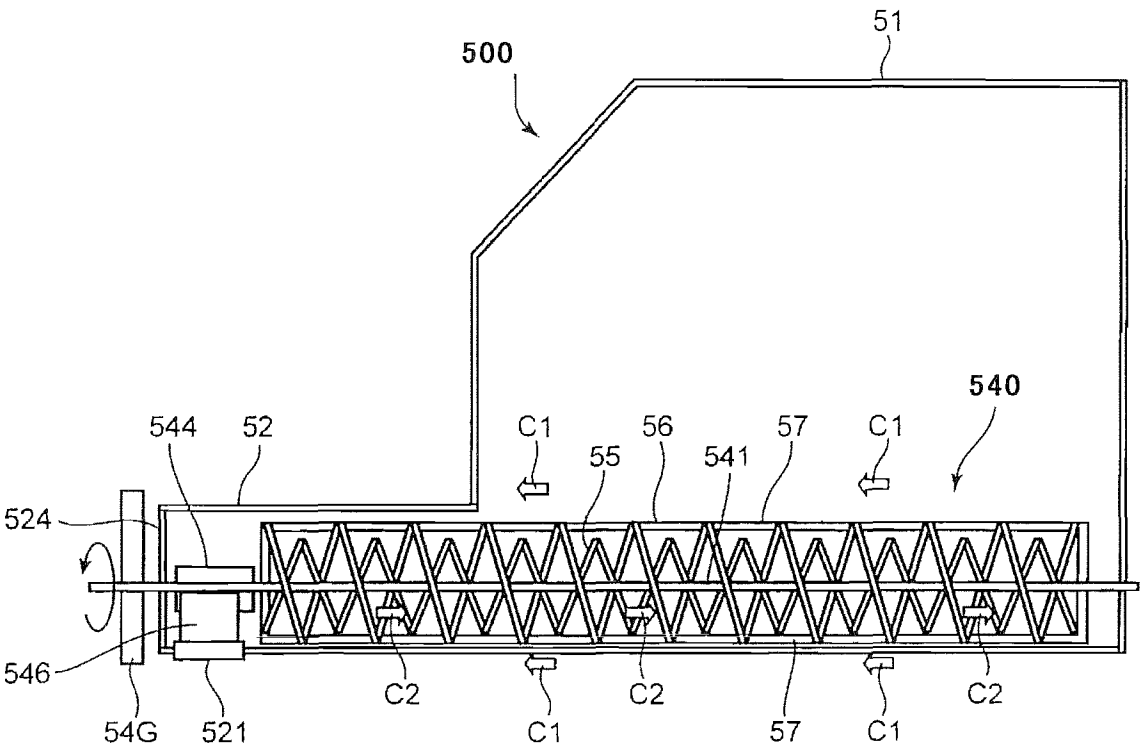
FIG. 27 is a schematic sectional side view of the toner container, illustrating how toner is moved by the rotating unit.
Figure 28:
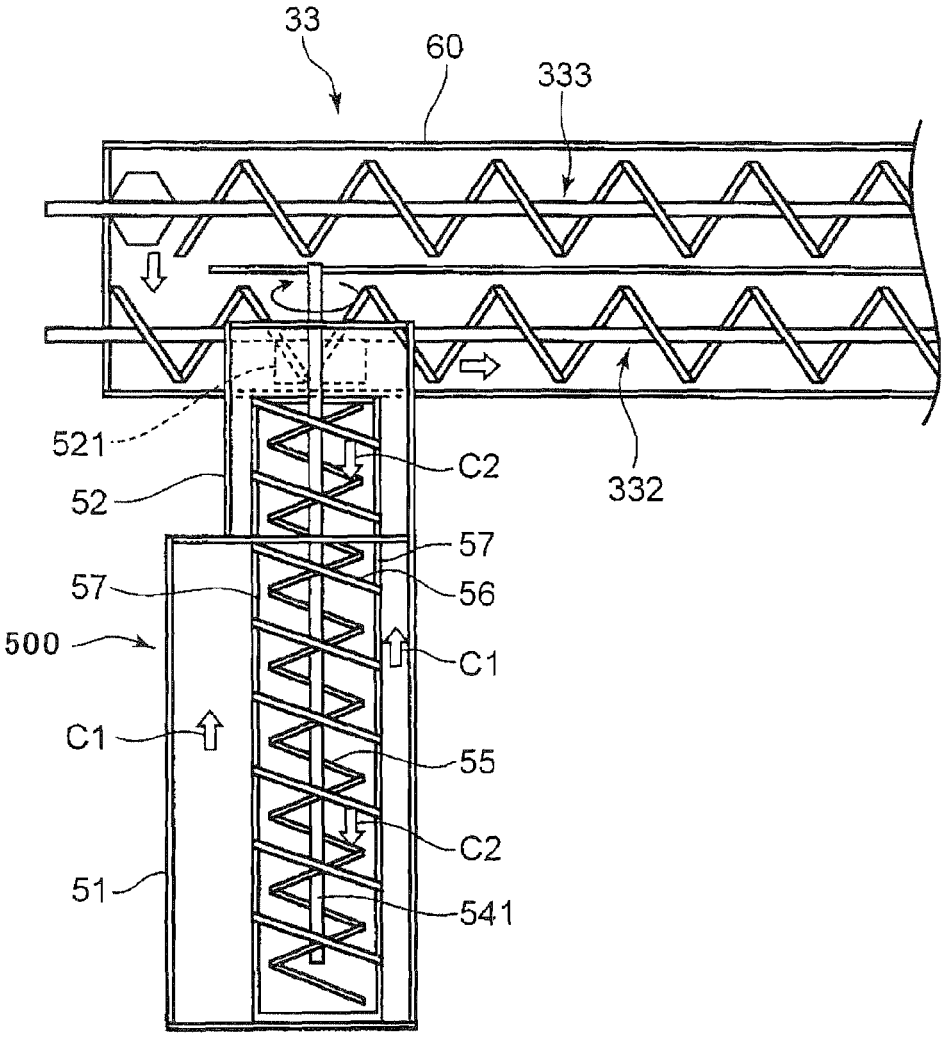
FIG. 28 is a schematic horizontal sectional view of the toner container and the developing unit, illustrating how toner is moved by the rotating unit.

As described above, in the rotating unit 540 of this embodiment, the radially inner portion (the first transport member 55) and the radially outer portion (the second transport member 56) transport toner in different directions. The toner transport operation by the rotating unit 540 will be described with reference to FIG. 27 and FIG. 28. FIG. 27 is a schematic sectional side view of a toner container, for illustrating the toner transport operation by the rotating unit. FIG. 28 is a schematic horizontal sectional view of the toner container and the developing unit.

The second transport member 56 is rotationally driven and thereby applies a pressing force in the second transport direction to toner. Toner caused to move toward the cylindrical portion 52 by the second transport member 56 moves exclusively in the vicinity of the outer circumference of the rotating unit as shown by arrows C1. The same is true in the cylindrical portion 52. In the vicinity of the inner circumferential wall of the cylindrical portion 52, toner moves toward the second end portion 524. At the same time, the dispersing members 57 disperse toner in the vicinity of the second transport member 56 in the radial direction, and thus toner moves smoothly in the second transport direction.

Toner transported in the second transport direction finally reaches the second end portion 524 of the cylindrical portion 52. Being pressed by the film 546, part of toner falls through the discharge port 521 into the housing 60. The toner is circulated in the housing 60 by the first and second screws 332 and 333.

Toner that has not been discharged through the discharge port 521 is reversely transported by the driving of the first transport member 55, as shown by arrows C2 in the figures, exclusively in the part of the cylindrical portion 52 near the central axis, in the first transport direction. The reversely transported toner passes across the border between the cylindrical portion 52 and the main body 51, and while being dispersed in the radial direction (the direction toward the central axis) by the dispersing members 57, the toner is returned to the main body 51.

As described above, the toner container 500 of this embodiment has such a circulation movement that toner moved to the cylindrical portion 52 by the second transport member 56 is returned to the main body 51 by the first transport member 55. For this reason, even in a toner container 500 in which a discharge port 521 is located at the distal end of a cylindrical portion 52, toner can be prevented from clumping in the vicinity of the discharge port 521.

The cylindrical portion 52 has an internal space that has a circular cross-sectional shape corresponding to the rotation locus of the second transport member 56, which is the most radially extending part of the rotating unit 540, that is, a tubular internal space that has an internal diameter slightly greater than the external diameter of the spiral of the second transport member 56. In the case where in a toner container 500 having such a cylindrical portion 52, the rotating unit 540 only transports toner in the second transport direction, and if the amount of discharged toner is less than the amount of sent toner, toner is trapped and packed in the cylindrical portion 52 and finally clumps. Clumps of toner block the discharge port 521, thereby preventing toner from being discharged. In the toner container 500 of this embodiment, the first transport member 55 has a transport function to reversely transport toner in the first transport direction in the cylindrical portion 52, and thus toner is not packed. In the cylindrical portion 52, toner cannot move radially outward, and thus toner tries to move toward the axis of the cylindrical portion 52. In the axis part, the first transport member 55 is disposed and transports toner in the first transport direction. Thus, before toner clumps, toner can be efficiently returned from the cylindrical portion 52 to the main body 51.

In particular, in the rotating unit 540 of this embodiment, the external diameter of the spiral of the second transport member 56 decreases toward the second transport direction, and the internal diameter of the cylindrical portion 52 also decreases toward the distal end (second end portion 524). For this reason, toner is smoothly transported along these tapered shapes toward the discharge opening 521 (toward the distal end) of the cylindrical portion 52. On the other hand, the internal diameter of the spiral of the second transport member 56 is substantially uniform over the entire length of the rotating shaft 541 in the axial direction. For this reason, the transportation of toner in the first transport direction by the first transport member 55 located inside is not hindered. Thus, toner can be stably returned from the cylindrical portion 52 to the main body 51 by the first transport member 55.

According to this embodiment, in a toner container 500 having a container shape including a main body 51 and a cylindrical portion 52 extending from the main body 51 and having a discharge port 521, toner can be prevented from clumping in the cylindrical portion 52. Thus, a toner container 500 that can supply toner stored in a main body 51 to the developing unit 33 such that little toner remains in the main body, can be provided.

Although a toner container 500 according to another embodiment of the present disclosure has been described, the present disclosure is not limited to this. For example, the following other embodiments can be made.

(1) In the above-described embodiment, a toner container 500 is shown as a specific example of a developer case. Examples of developer cases include a developing unit that combines a toner reservoir, a developing roller, and others, and an intermediate hopper interposed between a toner container and a developing unit.

(2) In the above-described embodiment, an example in which a rectangular film 546 is attached to the end of the rotating shaft 541 of the rotating unit 540 is shown. Instead of this, a trapezoidal film 546A, such as that shown in FIG. 19, may be attached.

Figure 29:
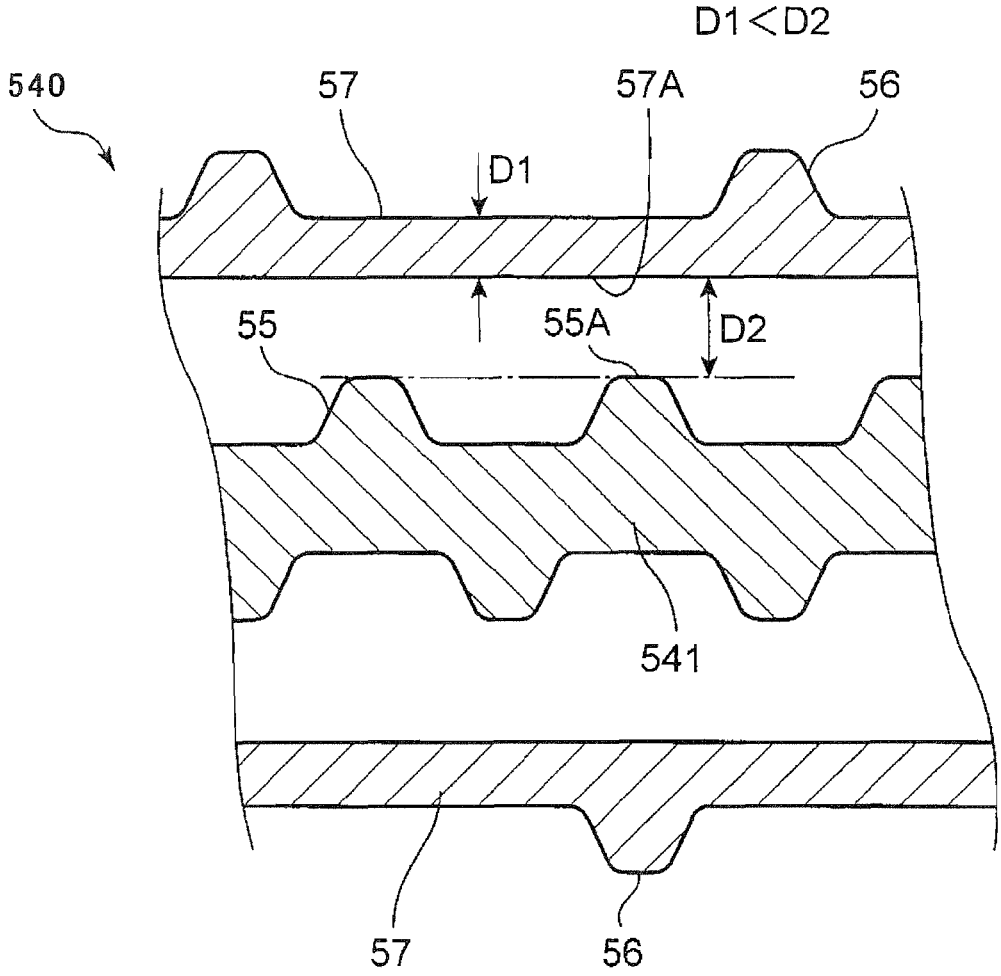
FIG. 29 is a partial sectional view of the rotating unit, showing an example of the rotating unit.

(3) The above-described example of the rotating unit 540 will be described with reference to FIG. 29. FIG. 29 is a partial sectional view of the rotating unit 540. A preferable embodiment concerning the relationship between the thickness of the dispersing members 57 and the distance between the outermost circumference of the spiral of the first transport member 55 and the radially inner surface of the pair of dispersing members 57 will be shown. The thickness of the dispersing members 57 in the radial direction of the rotating shaft 541 is denoted by D1. The distance between the outermost circumferential part 55A of the spiral of the first transport member 55 and the radially inner surface 57A of the pair of dispersing members 57 is denoted by D2.

In this case, it is preferable that the distance D2 be greater than the thickness D1. Since the distance D2 is greater than the thickness D1, a sufficient space exists between the outermost circumferential part 55A of the spiral of the first transport member 55 and the radially inner surface 57A of the pair of dispersing members 57. Thus, the region where toner is transported by the first transport member 55 is secured in the inside of the spiral of the second transport member 56. Thus, toner can be reliably transported in the first transport direction by the first transport member 55.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A developer case comprising:

a main body having a bottom wall and containing developer;

a cylindrical portion connected to the bottom wall, extending from the main body, and having a discharge port; and a rotating unit positioned so as to extend across the main body and the cylindrical portion and transporting the developer in the main body, wherein the rotating unit includes a rotating shaft that extends in a direction in which the bottom wall extends and has a first portion located in the main body and a second portion located in the cylindrical portion, a first transport member that is located on the circumferential surface of the second portion of the rotating shaft, rotates integrally with the rotating shaft, and transports the developer in a first transport direction from the cylindrical portion to the main body, a second transport member that is located over the circumferential surface of the first portion of the rotating shaft and on the radially outer side of the first transport member, rotates integrally with the rotating shaft, and transports the developer at least in a second transport direction from the main body to the cylindrical portion, and dispersing members that extend parallel to the rotating shaft and across the first portion and the second portion and move the developer in the radial direction.

2. The developer case according to claim 1, wherein the first transport member is also positioned on the circumferential surface of the first portion of the rotating shaft.

3. The developer case according to claim 2, wherein the first transport member spirally extends from the circumferential surface of the rotating shaft, and the second transport member is spiral and has a hollow portion into which the rotating shaft having the first transport member can be inserted.

4. The developer case according to claim 3, wherein the second transport member has a spiral piece that transports the developer in the first transport direction, toward the cylindrical portion-side end of the first portion.

5. The developer case according to claim 4, wherein the following expression is satisfied:

$$\alpha>\beta>0.7\alpha,$$

where $\alpha$ is the acute angle between the spiral of the second transport member and the dispersing members, and $\beta$ is the acute angle between the spiral piece and the dispersing members.

6. The developer case according to claim 3, wherein the dispersing members are attached to the second transport member and have a thickness D1 in the radial direction of the rotating shaft, and a distance D2 between the outermost circumference of the spiral of the first transport member and the radially inner surface of the dispersing members is greater than the thickness D1.

7. The developer case according to claim 1, wherein the discharge port is an opening located in the lower surface of the cylindrical portion, and a flexible pressing member extending in a direction perpendicular to the axial direction of the rotating shaft is attached to part of the rotating shaft corresponding to the opening.

8. The developer case according to claim 7, wherein the rotating shaft has a holding piece integrally attached to the cylindrical portion-side end thereof, the flexible pressing member is a film, and the film has a base end portion attached to the holding piece and a free end portion on the side opposite to the base end portion, and the length of the free end portion in the axial direction of the rotating shaft is greater than that of the base end portion, and part of the free end portion is located over the rotating shaft.

9. The developer case according to claim 1, comprising a sensor that detects the developer, and the sensor is attached to part of the side surface of the main body where the cylindrical portion-side end of the second transport member is located.

10. The developer case according to claim 1, wherein the cylindrical portion has an inner wall surface that is circular in cross-section, the bottom wall of the main body has a semicircular inner wall surface corresponding to the rotation locus of the most radially extending part of the second transport member, and the semicircular inner wall surface is connected to the circular inner wall surface of the cylindrical portion, the main body includes a first side wall that extends upwardly from one end of the bottom wall, a second side wall that extends upwardly from the other end of the bottom wall and faces the first side wall, a third side wall that connects one end edge of the first side wall and one end edge of the second side wall, and a fourth side wall that faces the third side wall and connects the other end edge of the first side wall and the other end edge of the second side wall, the cylindrical portion extends from the third side wall, and the rotating shaft has a first end portion and a second end portion on the side opposite to the first end portion, the first end portion is rotatably supported by the fourth side wall, and the second end portion is rotatably supported by the extending distal end surface of the cylindrical portion.

11. An image forming apparatus comprising:

an image bearing member that bears a developer image on the circumferential surface thereof;

a developing unit that supplies developer to the image bearing member; and a developer case that is detachably connected to the developing unit and supplies the developer to the developing unit, wherein the developer case includes a main body having a bottom wall and containing developer, a cylindrical portion connecting to the bottom wall, extending from the main body, and having a discharge port, and a rotating unit located so as to extend across the main body and the cylindrical portion and transports the developer in the main body, and the rotating unit includes a rotating shaft that extends in a direction in which the bottom wall extends and that has a first portion located in the main body and a second portion located in the cylindrical portion, a first transport member that is located on the circumferential surface of the second portion of the rotating shaft, rotates integrally with the rotating shaft, and transports the developer in a first transport direction from the cylindrical portion to the main body, a second transport member that is located over the circumferential surface of the first portion of the rotating shaft and on the radially outer side of the first transport member, rotates integrally with the rotating shaft, and transports the developer in a second transport direction from the main body to the cylindrical portion, and dispersing members that extend parallel to the rotating shaft and across the first portion and the second portion and move the developer in the radial direction.

12. The image forming apparatus according to claim 11, wherein the developing unit has a developing roller that supplies developer to the circumferential surface of the image bearing member, and a housing having a shape that is elongate in a first direction along the axial direction of the developing roller, and the developer case is connected to the developing unit such that the rotating shaft extends in a second direction perpendicular to the first direction.

13. The image forming apparatus according to claim 11, wherein the developer case is connected to the developing unit with the discharge port being lower and the main body side inclined upwardly, and the inclination angle of the developer case is less than the angle of repose of the developer contained in the developer case.

14. A developer case comprising:

a main body having a bottom wall and containing developer;

a cylindrical portion connecting to the bottom wall, protruded from the main body, and having a discharge port; and a rotating unit provided so as to extend across the main body and the cylindrical portion and transporting the developer in the main body, wherein the rotating unit includes a rotating shaft that extends in a direction in which the bottom wall extends, a first transport member that is located on the circumferential surface of the rotating shaft, rotates integrally with the rotating shaft, and transports the developer in a first transport direction from the cylindrical portion to the main body, and a second transport member that is located over the circumferential surface of the rotating shaft and on the radially outer side of the first transport member, rotates integrally with the rotating shaft, and transports the developer at least in a second transport direction from the main body to the cylindrical portion, and the cylindrical portion has an inner wall surface that is circular in cross-section and corresponds to the rotation locus of the most radially extending part of the second transport member.

15. The developer case according to claim 14, wherein the first transport member spirally extends from the circumferential surface of the rotating shaft, the second transport member is spiral and has a hollow portion into which the rotating shaft having the first transport member can be inserted, and an external diameter of the spiral of the second transport member decreases toward the second transport direction.

16. The developer case according to claim 15, wherein the internal diameter of the spiral of the second transport member is substantially uniform over the entire length of the rotating shaft in the axial direction.

17. The developer case according to claim 15, wherein the rotating unit includes dispersing members that extend parallel to the rotating shaft, are attached to the second transport member, and move the developer in the radial direction, the dispersing members have a thickness D1 in the radial direction of the rotating shaft, and a distance D2 between the outermost circumference of the spiral of the first transport member and the radially inner surface of the dispersing members is greater than the thickness D1.

18. The developer case according to claim 14, wherein the rotating unit further includes dispersing members that extend parallel to the rotating shaft and move the developer in the radial direction.

19. The developer case according to claim 14, wherein the discharge port is an opening located in the lower surface of the cylindrical portion, and a flexible pressing member extends in a direction perpendicular to the axial direction of the rotating shaft and is attached to part of the rotating shaft corresponding to the opening.

20. The developer case according to claim 19, wherein the rotating shaft includes a holding piece integrally attached to the cylindrical portion-side end thereof the flexible pressing member is a film, and the film has a base end portion attached to the holding piece and a free end portion on the side opposite to the base end portion, and the length of the free end portion in the axial direction of the rotating shaft is greater than that of the base end portion, and part of the free end portion is located over the rotating shaft.

21. The developer case according to claim 14, wherein the bottom wall of the main body has a semicircular inner wall surface corresponding to the rotation locus of the most radially extending part of the second transport member, and the semicircular inner wall surface is connected to the circular inner wall surface of the cylindrical portion, the main body includes a first side wall that extends upwardly from one end of the bottom wall, a second side wall that extends upwardly from the other end of the bottom wall and faces the first side wall, a third side wall that connects one end edge of the first side wall and one end edge of the second side wall, and a fourth side wall that faces the third side wall and connects the other end edge of the first side wall and the other end edge of the second side wall, the cylindrical portion extends from the third side wall, and the rotating shaft has a first end portion and a second end portion on the side opposite to the first end portion, the first end portion is rotatably supported by the fourth side wall, and the second end portion is rotatably supported by the extending distal end surface of the cylindrical portion.

22. An image forming apparatus comprising:

an image bearing member that bears a developer image on the circumferential surface thereof;

a developing unit that supplies developer to the image bearing member; and a developer case that is detachably connected to the developing unit and supplies the developer to the developing unit, wherein the developer case includes a main body having a bottom wall and containing developer, a cylindrical portion connecting to the bottom wall, extending from the main body, and having a discharge port, and a rotating unit located so as to extend across the main body and the cylindrical portion and transports the developer in the main body, the rotating unit includes a rotating shaft that extends in a direction in which the bottom wall extends, a first transport member that is located on the circumferential surface of the rotating shaft, rotates integrally with the rotating shaft, and transports the developer in a first transport direction from the cylindrical portion to the main body, a second transport member that is located over the circumferential surface of the rotating shaft and on the radially outer side of the first transport member, rotates integrally with the rotating shaft, and transports the developer in a second transport direction from the main body to the cylindrical portion, and the cylindrical portion has an inner wall surface that is circular in cross-section and corresponds to the rotation locus of the most radially protruding part of the second transport member.

23. The image forming apparatus according to claim 22, wherein the developing unit has a developing roller that supplies developer to the circumferential surface of the image bearing member, and a housing having a shape that is elongate in a first direction along the axial direction of the developing roller, and the developer case is connected to the developing unit such that the rotating shaft extends in a second direction perpendicular to the first direction.

* * * * *